US006718803B2

(12) United States Patent
Knoll

(10) Patent No.: US 6,718,803 B2
(45) Date of Patent: Apr. 13, 2004

(54) COMBINATION LOCK

(75) Inventor: Yehonatan Knoll, Tiven (IL)

(73) Assignee: Knollan Ltd., Ramat Ishai (IL)

( * ) Notice: Subject to any disclaimer, the term of this patent is extended or adjusted under 35 U.S.C. 154(b) by 0 days.

(21) Appl. No.: 10/138,532

(22) Filed: May 6, 2002

(65) Prior Publication Data

US 2003/0205069 A1 Nov. 6, 2003

(51) Int. Cl.[7] ..... E05B 37/06; E05B 37/10; E05B 37/14

(52) U.S. Cl. ..... 70/26; 70/288; 70/305; 70/316; 70/DIG. 9

(58) Field of Search ..... 70/24–28, 288, 70/289, 301, 304–308, 312, DIG. 9, 315, 214, 313, 321, 323, 316, 213, 303 A

(56) References Cited

U.S. PATENT DOCUMENTS

| | | | | | |
|---|---|---|---|---|---|
| 745,064 | A | * | 11/1903 | Katzenberger | 70/28 |
| 825,735 | A | * | 7/1906 | Katzenberger | 70/28 |
| 1,054,596 | A | * | 2/1913 | Molvig | 70/304 |
| 1,119,527 | A | * | 12/1914 | Mueller | 200/43.09 |
| 1,434,787 | A | * | 11/1922 | Mauldin | 70/207 |
| 2,049,983 | A | | 8/1936 | Voges | |
| 2,201,494 | A | * | 5/1940 | Keith | 70/219 |
| 2,491,779 | A | | 12/1949 | Smith | |
| 2,830,447 | A | | 4/1958 | Miller | |
| 2,931,204 | A | | 4/1960 | Check | |
| 3,416,337 | A | * | 12/1968 | Hutchins | 70/284 |
| 3,667,261 | A | * | 6/1972 | McGourty | 70/301 |
| 3,952,559 | A | * | 4/1976 | Atkinson | 70/25 |
| 4,476,698 | A | | 10/1984 | Treslo | |
| 4,719,777 | A | * | 1/1988 | Hwang | 70/312 |
| 4,733,548 | A | | 3/1988 | Ling | |
| 5,109,684 | A | | 5/1992 | Grandy | |
| 5,267,460 | A | | 12/1993 | Burleigh | |
| 5,345,798 | A | * | 9/1994 | Nakai | 70/284 |
| 5,582,049 | A | * | 12/1996 | Mauer | 70/312 |
| 6,082,155 | A | * | 7/2000 | Su | 70/22 |
| 6,298,694 | B1 | | 10/2001 | Knoll | |

FOREIGN PATENT DOCUMENTS

| | | |
|---|---|---|
| CH | 274 764 | 4/1951 |
| DE | 155 491 | 11/1904 |

* cited by examiner

*Primary Examiner*—John B. Walsh
(74) *Attorney, Agent, or Firm*—Nath & Associates PLLC; Gary M. Nath; Lee C. Heiman

(57) ABSTRACT

A combination lock comprising a housing, a locking bolt and a locking breach, at least one locking assembly rotatably supported within the housing and comprising a disc member formed with a peripheral recess, a cam wheel and a reset cam. A locking member is formed with at least one locking lug angularly displaceable between an un-locked position in which all the looking lugs engage within the peripheral recess of the disc members and where the locking breach is disengaged from the locking bolt, and a locked position in which at least one of the locking lugs is disengaged from the peripheral recess, where the locking breach arrests the locking bolt. A planarly displaceable manipulating member comprises at least one follower corresponding with each cam wheel. A reset mechanism is provided for rotating all disc members into a reset position.

40 Claims, 19 Drawing Sheets

COMBINATION LOCK

FIELD OF THE INVENTION

The present invention is generally in the field of locks and more specifically it is concerned with combination locks, at times referred to as key-less locks. In particular the invention is concerned with a lock in which unlocking is obtained by consecutive displacements of a manipulating member.

Such locks are useful as padlocks, case locks (e.g. suitcases, briefcases), doors, windows, safes, lockers, bicycles, and the like. In particular the invention is concerned with a lock in which unlocking is obtained by consecutive displacements of a manipulating member.

BACKGROUND OF THE INVENTION

A combination lock as referred to in the art, is a lock which eliminates the use of a key for opening it. One type of such locks comprises a single dial which should be rotated several times in different directions to reach the correct opening combination. Another type of combination locks comprises several dials in which each should be rotated to a position in which the correct combination number is reached. Optionally, rather then dials, there are combination locks in which a plurality of push-buttons are provided, which should be pressed in a correct sequence, to reach the right opening combination. The code which enables opening of the lock is at times referred to as a combination code, or an opening code.

The above described combination locks share several drawbacks. For example, where the locking mechanism is arranged in series, i.e. in order to render the locking mechanism some complication, it usually comprises three or more locking assemblies, each of which being separately handled. This arrangement results in that each locking assembly being successfully manipulated into its opening position, renders the picking procedure easier. Even single-dial combination locks, although comprising only one manipulating dial, comprise three or more locking assemblies, which are handled in series.

Still a further drawback of locks of the above described type is the mechanical complexity requiring a plurality of elements, each adapted for manipulating a single locking assembly of a locking mechanism. Furthermore, locking mechanism arranged in series, also require more time for opening.

In addition, in some combination locks, the lock remains unlocked, even if it is closed (the shackle being introduced into its opening within the padlock, or the door of a safe being closed) until positive displacement of at least one of its manipulating members.

Even more so, most locks require visual contact with the lock to establish manipulation thereof. Obviously, such a requirement may be problematic for blind people or in conditions of darkness. Additionally, in many situations it might be required to enable manipulation of a lock using a single hand. Such locks are suitable, in particular for invalids etc. Many other types of locks, in particular security locks, are electrically or electronically operated, the drawbacks of which being obvious.

Known combination or key-less locks are described, for example, in U.S. Pat. Nos. 2,049,983, 2,830,447, 2,931,204, 4,476,698, 4,733,548, 5,109,684 and 5,267,460. However, it is considered that none of these patents provides an adequate solution for the above referred to drawbacks. U.S. Pat. No. 2,491,779 discloses a combination lock comprising four actuating pins of different lengths, each adapted for engagement in turn with a corresponding lever of the four discs. A manipulating plate displaces each time only one of the levers, thus entailing angular displacement of a single disc at a time to the extent of one notch at a time.

U.S. Pat. No. 6,298,694B1 by the same inventor as the present invention, discloses an improved combination lock which differs from locks described above in that it comprises a single manipulating member wherein the opening code is obtained by a series of consecutive planar displacements of a single manipulating member, in a so-called X-Y pattern.

Whilst the concept presented by the above referred to Patent is a breakthrough in its field and has many advantages over prior art combination locks, nevertheless it has several deficiencies, in particular concerning its design and assembly. For example, the disclosed lock comprises at least two coaxially disposed rotatable locking assemblies, each comprising a cogged wheel, a locking disk and a reset element, arranged in series, thereby rendering the housing of the lock considerable size, whereby it is not suitable for used at a confined space.

It is the object of the present invention to provide a combination lock mechanism, in which the above referred to disadvantages are significantly reduced or overcome and which allow easy manipulation of the lock single handed and without visual contact with the lock.

SUMMARY OF THE INVENTION

The present invention calls for a combination lock comprising a single manipulating member planarly displaceable, and where manipulation thereof does not require visual contact with the lock, whereby the lock is operable also by individuals with limitations e.g. young children, invalids (e.g. blind people, amputees or otherwise handicapped).

According to the present invention there is provided a combination lock comprising:

- a housing, a locking bolt with at least one leg portion extending into the housing and formed with a locking latch, and a locking breach for arresting said locking latch;
- at least one locking assembly rotatably supported within the housing; each locking assembly comprising a disc member formed with a peripheral recess, a cam wheel formed with a cam teeth, and a reset cam;
- a locking member formed with at least one locking lug, each corresponding with a disc member; said locking member being angularly displaceable between an un-locked position in which all the at least one looking lugs are engaged within the peripheral recess of the corresponding disc member and wherein the locking breach is disengaged from the locking bolt; and a locked position in which at least one of the locking lugs is disengaged from the corresponding peripheral recess, wherein the locking breach arrests the locking bolt;
- a reset mechanism comprising a lever for applying force on the reset cam of each of the at least one locking assembly, to thereby rotate the associated disc member into a reset position;
- a manipulating member comprising at least one follower corresponding with each cam wheel and being planarly displaceable within the housing;
- the arrangement being such that upon predetermined consecutive displacements of the manipulating member corresponding with a combination of the lock, the at least one follower encounters the cam teeth of a respective cam wheel, entailing corresponding consecutive angular displacement of each of the at least one locking assembly into a position in which each of the peripheral recesses faces a corresponding locking lugs, thus allowing the locking member to shift into the un-locked position.

According to a first application of a combination lock according to the present invention there are provided at least two locking assemblies, planarly disposed within the housing about a central axis thereof, and wherein the locking member is angularly displaceable about the central axis.

According to a second application, the lock comprises at least two locking assemblies coaxially disposed within the housing, wherein the locking member is in the form of a lever comprising a corresponding number of locking lugs and pivotally displaceable between the locked and the un-locked positions. According to a specific embodiment at the un-locked position the peripheral recesses are axially aligned and further, the locking lugs of the locking member are axially aligned.

According to an embodiment of the invention, the locking breach is pivotally articulated to the locking member wherein displacing the locking member into its un-locked position enables displacement of the locking breach, by pulling the locking bolt, into disengagement from the locking latch of the locking bolt, and wherein displacing the locking member into its locked position entails corresponding displacement of the locking breach into engagement with said locking latch.

According to a specific design, the locking breach is a bar formed with at least one latch engaging portion; wherein at the locked position the latch engaging portion engages with the locking latch to thereby arrests the locking bolt, and further wherein axial pulling force applied to the locking bolt entails displacement of the locking breach into engagement with the housing, whereby said axial pulling force wedges the locking breach within the housing at the locked position such that the axial force is not transferred to the locking member and the at least one locking assembly. According to one particular embodiment, the locking breach and the housing are each formed with a serrated portion, whereby engagement of the serrated portions entails wedging the locking breach at the locked position.

The combination lock according to the present invention may be a pre-programmed combination type, wherein the cam wheel and the reset cam are integral with the disc member. Alternatively, the combination may be personalized to include any practical sequential consecutive displacements of the manipulating member. Accordingly, at least the cam wheel is axially detachable from the disc member, whereby it can be angularly shifted to preset one of a plurality of angular positions, whereby the combination of the lock may be changed to any personalized combinations.

According to one particular design, the cam wheel comprises a central star-like member formed with a plurality of spikes, each spike having at cam surface slidingly engageable by a follower of the manipulating member. To increase the number of combinations, the cam wheel further comprises a circular array of cam elements disposed adjacent the periphery of the cam wheel, each cam element comprising a cam surface slidingly engageable by a follower of the manipulating member.

The manipulating member may comprise any suitable number of followers, engageable with the spikes of the cam wheel. According to one particular design there are provided three followers per each cam wheel, for cooperation in conjunction therewith. According to a specific design, the followers are in the form of pins projecting from the manipulating member.

According to the present invention, resetting the combination code, i.e. personalizing it, is make easy upon disengaging the disc member of at least one locking assembly from its associated cam wheel, angularly displacing the cam wheel and reengaging it with the disc member. Disengaging the disc members from their associated cam wheel is carried out by axial separation therebetween. Such axial separation is achieved by a separating member formed with one or more ramped surfaces and being rotatable within the housing. A corresponding member fitted for traveling over said ramped surfaces imparts axial force on the locking assemblies, to thereby separate the disc members from their associated cam wheel.

According to the first application of the invention, where the locking assemblies are disposed in a planner layout, each disc member is biased to disengage from its related cam wheel, wherein said corresponding member is the locking member, and wherein axial displacement thereof results in said separation. According to the second application of the invention, where the locking assemblies are coaxially received within the housing, the corresponding member is a seat member adapted for applying axial force against a coupling element associated with each locking assembly applying, entailing axial displacement of only one of the disc member or the cam wheel of each locking assembly, against the axial biasing effect of a biasing member.

BRIEF DESCRIPTION OF THE DRAWINGS

In order to understand the invention and to see how it may be carried out in practice, some embodiments will now be described, by way of non-limiting examples only, with reference to the accompanying drawings, in which:

FIG. 5B illustrates an attempt to force-open the lock;

FIG. 19(*b*) is a drawing which depicts a combination lock according to the inventive subject matter, wherein the locking bolt is linked to the chain.

FIG. 19(*c*) is a drawing which depicts a combination lock according to the inventive subject matter, being a built-in lock wherein the housing is bolted to a door or frame member.

FIG. 19(*d*) is a drawing which depicts a combination lock according to the inventive subject matter, being a firearm safety lock and wherein the locking bolt is fitted for locking engagement with a trigger guard of the firearm.

DETAILED DESCRIPTION OF THE INVENTION

In the following description, with reference to the annexed drawings, the illustrated embodiment is a padlock. However, it is appreciated that the lock may rather be a so-called bicycle chain lock, a built-in lock wherein the housing is bolted to a door or frame member (or to a component of a case, e.g. a briefcase, etc,) a firearm safety lock, etc.

Figure 1:
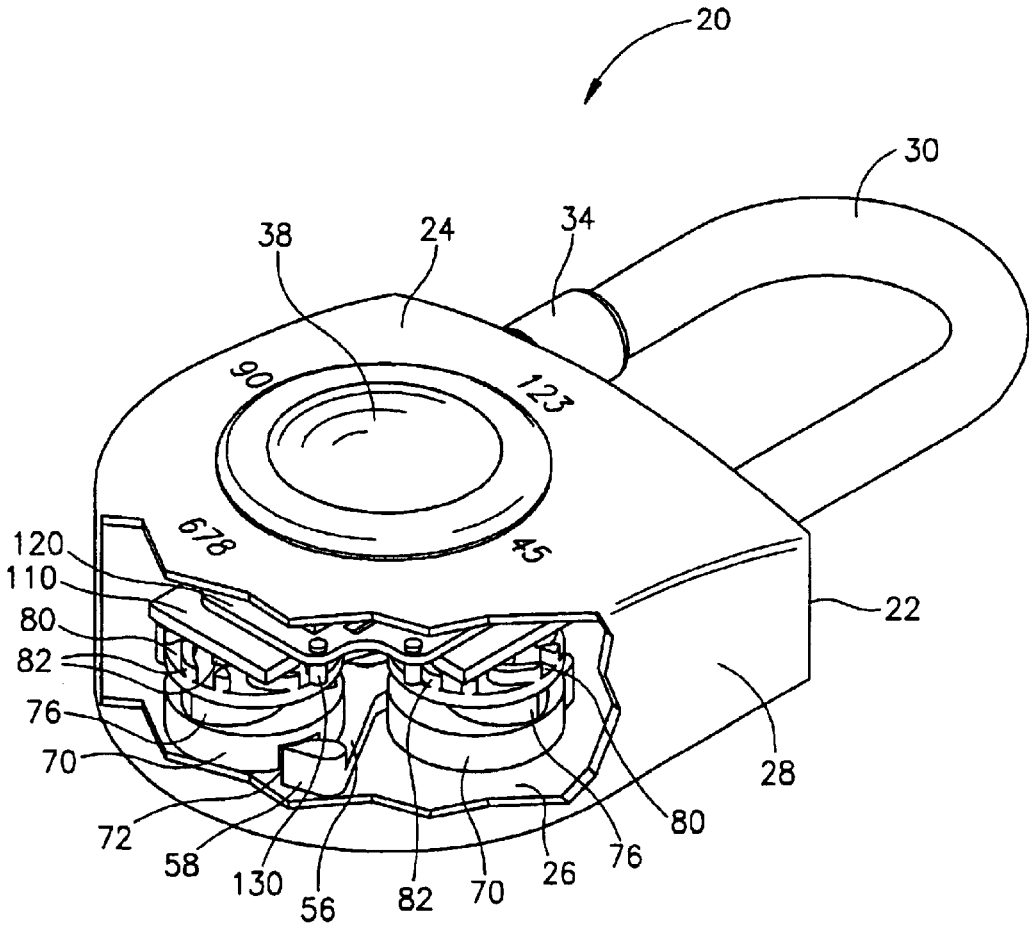
FIG. 1 is partially sectioned isometric view of a padlock in accordance with an embodiment of the present invention.
Figure 2:
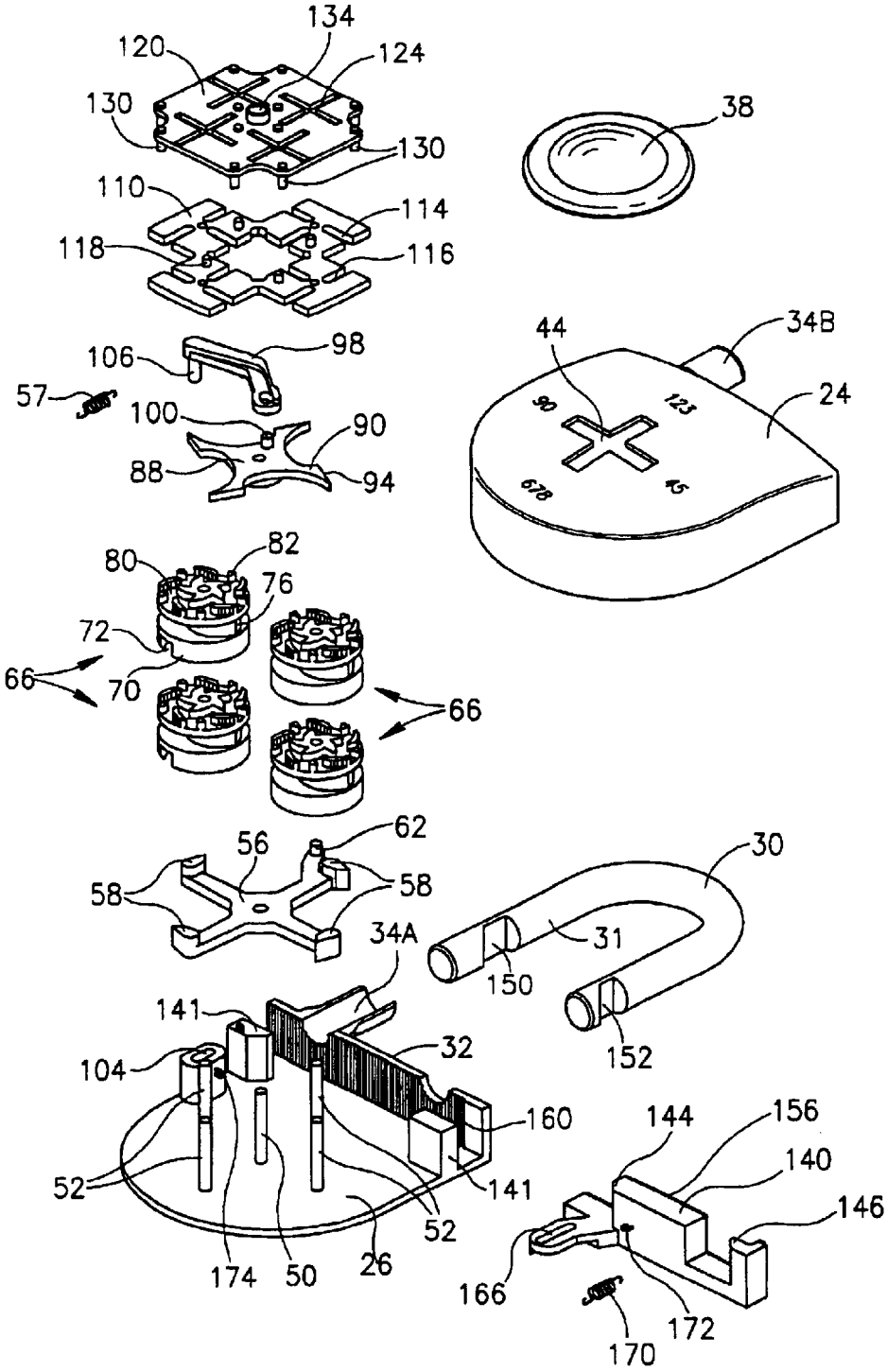
FIG. 2 is an exploded isometric view of the padlock seen in FIG. 1.

Turning first to FIGS. 1 and 2, there is illustrated a padlock generally designated 20 comprising a housing 22 formed with a top wall 24, a base wall 26 and a peripheral wall 28 securely assembled. A U-like shackle 30 comprises a short leg and a long leg 31, both receivable within the housing through top wall 32, wherein at least the long leg 31 of the shackle is secured by a tamper proof guarding cylinder 34 which may be a uniform cylinder (FIG. 1) or constructed of two halves 34A and 34B (FIG. 2).

A finger-engageable manipulating piece 38 is displaceable over the top wall 24, in a cross-like pattern, i.e. in an X-Y like pattern, as will be come apparent hereinafter. The top wall 24 is formed with an X-like opening 44 through which a manipulating knob 134 projects. The top wall 24 is also formed with orientation indicia, which in the present example are digits from 1 to 0. However, rather than digits there may be provided other characters, e.g. letters, signs, Braille signs, or there may be no indication whatsoever.

The bottom wall 26 of the housing 22 is formed with a central support pin 50 and four planarly disposed supporting pins 52. A cross-like locking member 56 is pivotally mounted on the central support pin 50, said locking member 56 comprising four arms with a locking lug 58 at the end of each one of them, essentially tangentially extending and at a position in which they "chase" each other, i.e. having the same orientation. Locking member 56 is also formed with a breach engaging pin 62. locking member 56 is biased into clockwise rotation, i.e. in a direction corresponding with the locking lug 58, by means of spring 57.

Rotatably mounted on each of the planarly disposed supporting pins 52, there is a locking assembly generally designated 66, each comprising a lowermost disk member 70 formed with a peripheral recess 72 (seen only in several of them), an intermediate reset cam 76 (which in accordance with the particular embodiment has a drop-like shape) and a top most cam wheel 80 formed with a plurality of cam teeth 82, as will be explained hereinafter in more detail with reference to the following drawings.

In the present embodiment the locking assembly 66 is a unitary item, i.e. the disk member 70 is integrally formed with the cam wheel and the reset cam. However, in accordance with a different embodiment, as will be explained hereinafter with reference to FIGS. 11 to 13, these components may be separable from one another.

Also mounted on the central support pin 50 there is a star-like reset member 88 formed with four arms 90, each formed at its end with a flat cam-engaging surface 94.

A reset lever 98 is pivotally coupled at one end thereof to an offset pin 100 projecting from the reset member 88 and at an opposed end there is a projecting pin 106 slidingly and pivotally received within receptacle 104 formed at the bottom wall 26 of the housing.

Fixedly positioned over supporting pins 50 and 52, there is a guiding track member 110 formed with a plurality of recesses 114 and 116 transversing each other at right angles (so as to correspond with the X-Y orientation of the opening 44 of the front wall 24). The guiding track member 110 may be otherwise secured within the housing, e.g. by means of suitable projections from the front wall 24 or from the side walls. Further noticed, the guiding track member 110 comprises four upwardly projecting studs 118.

Slidingly disposed above the guiding track member 110 there is a manipulating member 120 in the form of a plate formed with four cross-like recesses 124, each slidingly receiving a corresponding stud 118 of the guiding track member 110, to thereby ensure that the manipulating member 120 is displaceable only in an X-Y orientation. Downwardly projecting from the manipulating member 120 there are four equally disposed sets of followers in the form of three follower pins 130 suited for engagement with cam teeth 82 of cam wheels 80, as will become apparent hereinafter.

Centrally projecting from the manipulating member 120 there is a manipulating knob 134, extending through opening 44 and being engageable with the manipulating finger-engageable knob 38.

A locking breach 140 is in the form of a solid member slidingly received at a top portion of the housing, adjacent the top wall 32, said locking breach formed with two latch engaging projections 144 and 146 for engagement with locking latches 150 and 152, respectively of the shackle 30. The breach is laterally slidingly retained within the housing by two posts 141, though it has also some degree of displacement in a transverse direction, i.e. towards top wall 32.

A top surface 156 of the breach 140 is serrated in a corresponding member as of serrated inner face 160 of top wall 32, for a purpose to become apparent hereinafter. The locking breach 140 is pivotally coupled with the locking member 56 by means of the breach engaging pin 62 projecting from the locking member slidingly and pivotally received within receptacle 166 of the locking breach 140. The locking breach 140 is normally biased into a downward position, disengaged from the serrated inner face 160 of the housing, by means of coiled spring 170 hooked to the locking breach 140 at an eye hook 172 and to a suitable spring hook 174 formed in the housing.

Figure 3:
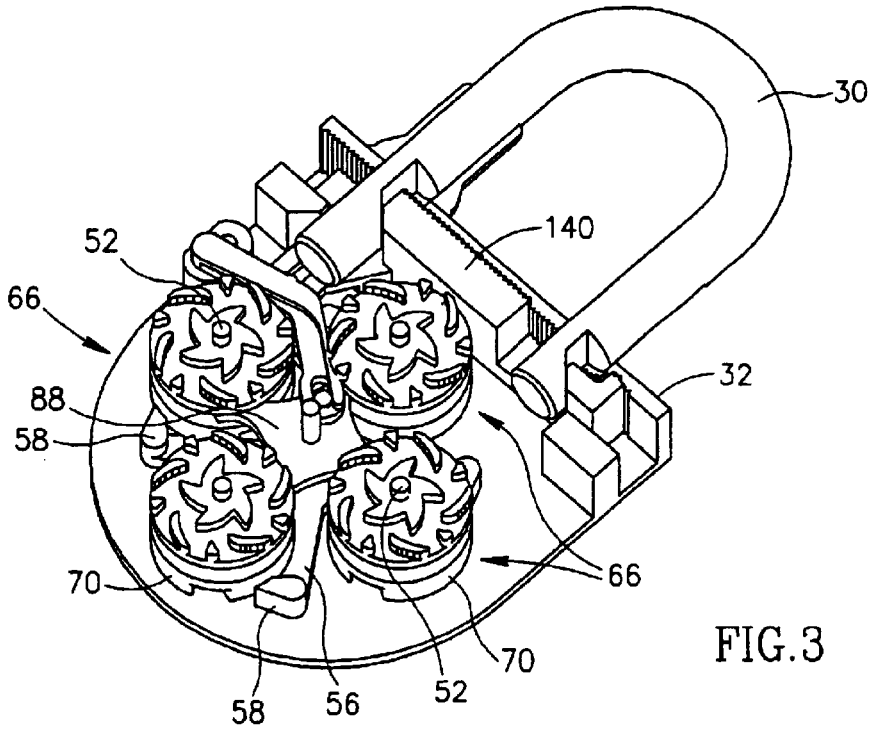
FIG. 3 is an isometric view of the lock seen in FIG. 2, with several components thereof being removed, the lock in a so-called locked position.

Turning now to FIG. 3, the lock is illustrated in a locked position, namely at which the shackle 30 is arrested and may not be retracted from the housing. In this position, all the locking lugs 58 of the locking member 56 are disengaged from their corresponding peripheral recesses 72 of the disk members 70, though one, two or three of the locking lugs 58 may be positioned opposite their corresponding peripheral recesses 72, in a step prior to entailing unlocking of the locking mechanism. At the locked position of FIG. 3, the locking member 56 is prevented from angular displacement in a clockwise direction, i.e. into engagement of the lugs 58 with the peripheral recesses 72 and thus, the locking breach 140 remains at its left-most position, whereby latch engaging portions 144 and 146 remain engaged within corresponding locking latches 150 and 152, respectively of the shackle 30, preventing opening of the lock, namely displacement of the shackle.

Figure 4:
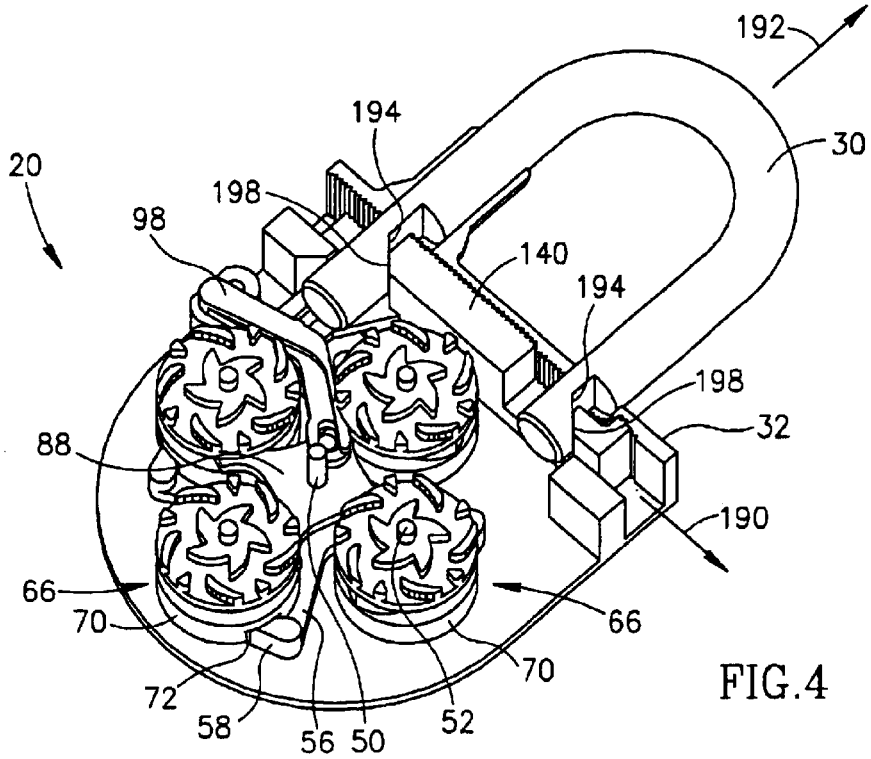
FIG. 4 is similar to FIG. 3, the locking mechanism in a so-called unlocked position, though the lock is still closed.

Turning now to the position referred to in FIG. 4, the lock 20 is in its unlocked position though not yet open, i.e. the shackle 30 remains in its position within the housing. In this position all lugs 58 of locking member 56 are received within their respective peripheral recesses 72 at the disk members 70, whereby under biasing effect of coiled spring 57 (FIG. 2) the locking member 56 has rotated in a clockwise direction, so as to facilitate engagement of the lugs 58 with the respective peripheral recess 72. Only in this position, the locking breach 140 may displace rightwards in the direction of arrow 190 under pulling influence of shackle 30 in the direction of arrow 192. This is obtained by inclined surfaces 194 of locking latches 150 and 152, respectively, of the shackle 30 applying axial force on correspondingly inclined surfaces 198 of the latch engaging portions 144 and 146 of locking breach 140, in an axial direction represented by arrow 190.

Thus, the arrangement is such that the lock may be in an unlocked position, as in FIG. 4, though the locking breach 140 and shackle 30 do not yet change their position and the lock remains closed. This arrangement is obtained by ensuring that when the locking member 56 displaces into its open position, it does not necessarily entail corresponding displacement of the locking breach 140 into its open position. This is obtained by forming the recess 166 (of the locking breach) such that displacement of the breach engagement pin 62 does not necessitate corresponding displacement of the locking breach 140.

Figure 5A:
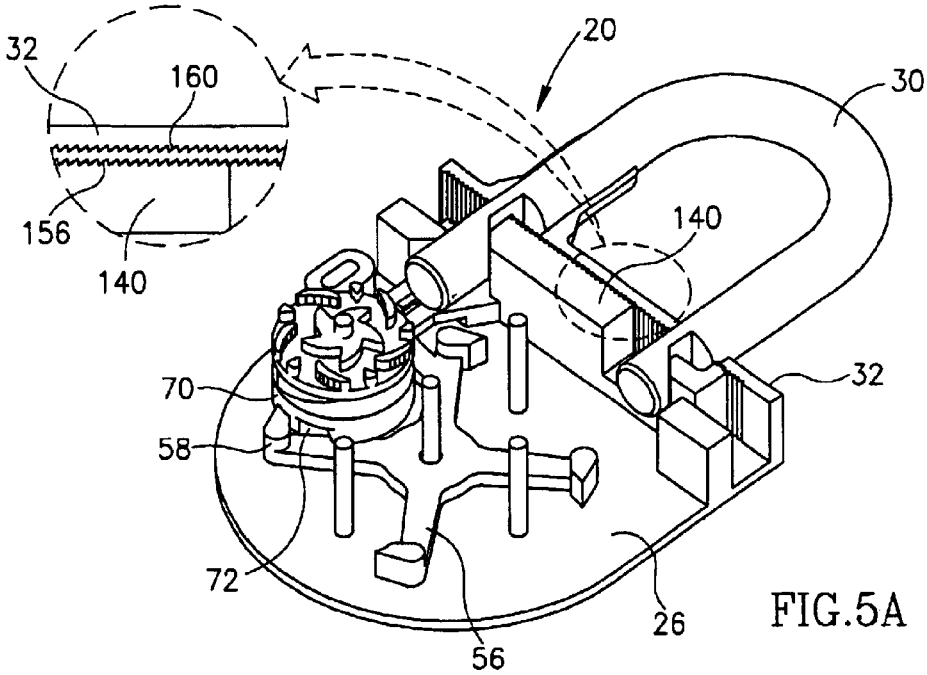
FIGS. 5A and 5B illustrate the locking mechanism in a locked position as in FIG. 3, where
Figure 5B:
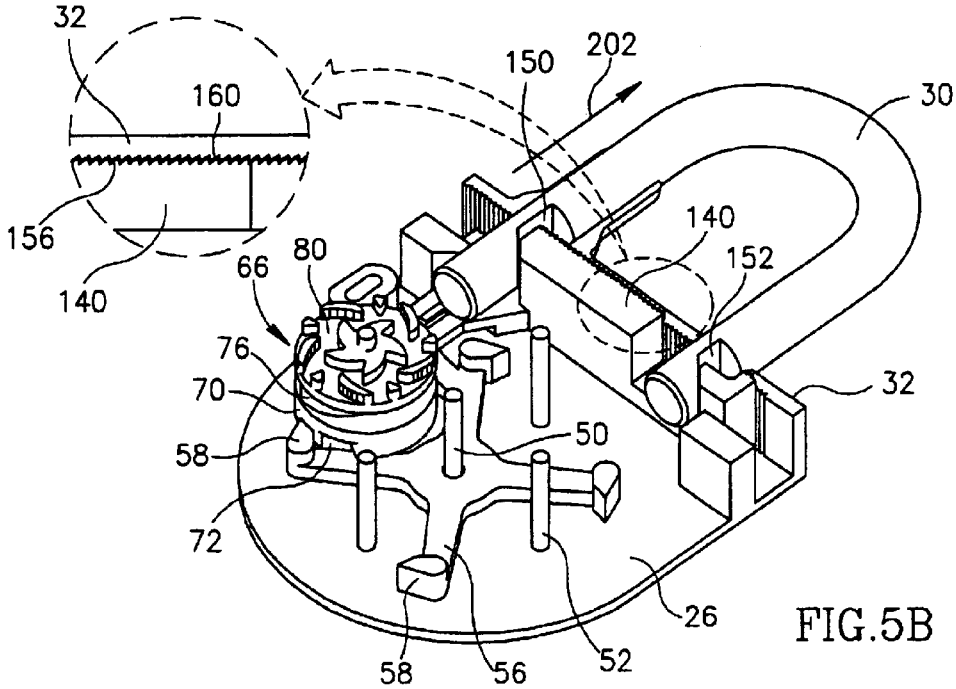

FIGS. 5A and 5B illustrate the lock in accordance with the present invention in a locked position and at an attempt to force the lock open (FIG. 5B) during that position. For the sake of clarity only one locking assembly is illustrated and some other elements have been removed as well.

In FIG. 5A, the lock 20 is in a locked position namely, at least one of the locking lugs 58 extends offset with respect to its corresponding peripheral recess 72 of disk member 70, whereby displacement of locking member 56 in a clockwise direction is not admitted, namely, the locking mechanism will not displace into an open position to allow corresponding displacement of the locking breach 140 to disengage from the shackle 30.

As illustrated in the enlarged portion of FIG. 5A, which is an elevation of that portion, the corresponding serrated portions 156 of locking member 140, and 160 of top wall 32, are disengaged from one another with a narrow gap therebetween. However, an attempt to pull shackle 30 in the direction of arrow 202 (FIG. 5B) entails displacement of locking member 140 towards the top wall 32 whereby the serrated surfaces 156 and 160 engage as clearly illustrated in the enlarged portion. Upon mating of the serrated portions, the locking breach 140 becomes arrested in a locked position, such that latch engaging portions 144 and 146 of the locking breach 140 remain engaged within corresponding locking latches 150 and 152 of the shackle 30. The locking breach 140 will not displace in the direction of arrow 190 as in FIG. 4 in spite applying force to the shackle in the direction of arrow 202.

It is further appreciated that the force applied to the shackle 30 in the direction of arrow 202 (FIG. 5B) is completely received by the locking breach 140, which in turn applies the force to the housing 22, whereby the components of the locking mechanism are not influenced by that pulling force, and will thus not deform or damage.

Figure 6A:
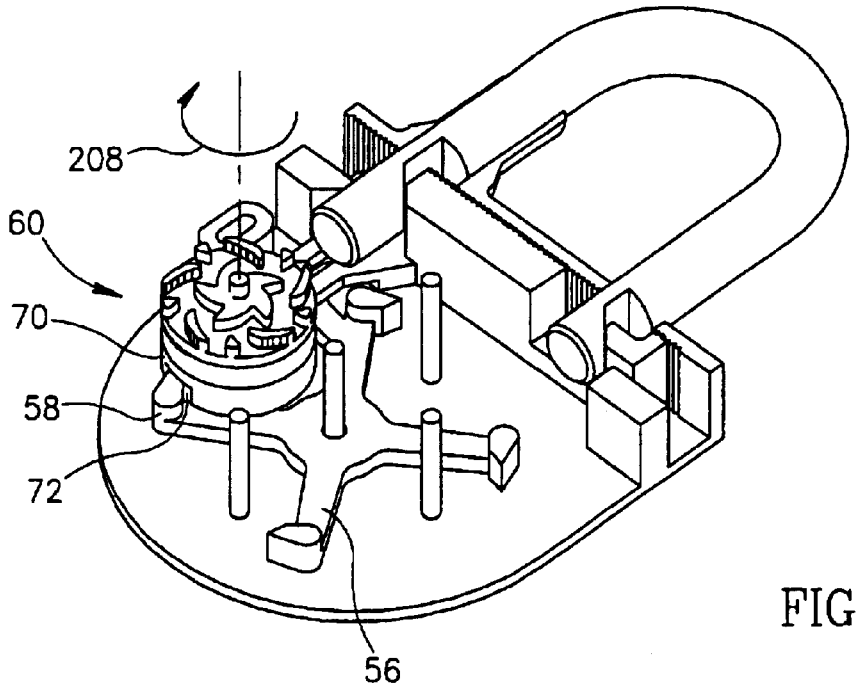
FIGS. 6A and 6B illustrate the lock in two consecutive steps of opening the lock.

Upon manipulating the manipulating member 120, the locking assemblies 60 perform a series of angular displacements in direction of arrow 208 (FIG. 6A), whereby upon completing the series of displacements, all the peripheral recesses 72 of the disks 70 are so positioned as to face the corresponding locking lugs 58 of locking member 56. Locking member 56 is normally biased in the direction of arrow 210 (FIG. 6B), by means of the spring 57 (FIG. 2), such that the locking lugs 58 bear against the periphery of the disc members 70. When all the recesses face the locking lugs, the locking lugs displace into engagement with the recesses 72, however, only upon correct manipulation, i.e. corresponding with the opening combination.

Figure 6B:
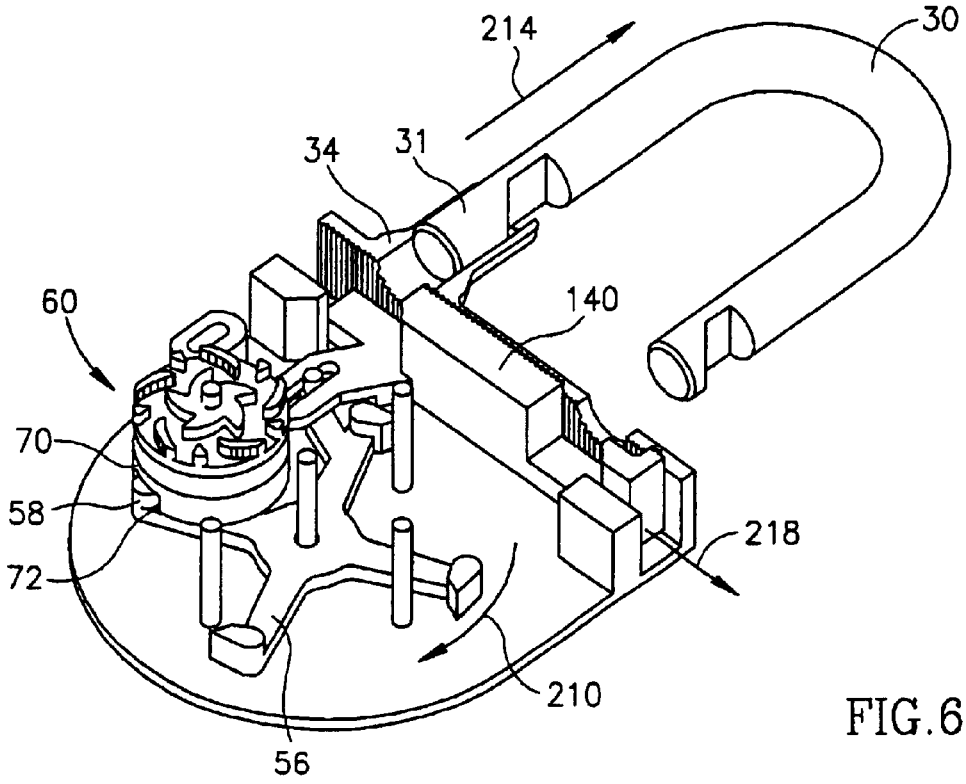

In the position of FIG. 6B, after the locking member 56 performs its angular displacement into engagement with recesses 72, the shackle 30 may be pulled in the direction of arrow 214 where at a first stage it will entail sliding displacement of locking breach 140 in the direction of arrow 218 and will then disengage therefrom, allowing axial displacement of the shackle and removal thereof. It is however appreciated that by a different modification (not shown) the longer leg 31 of shackle 30 remains arrested within the guarding cylinder 34.

Figure 7A:
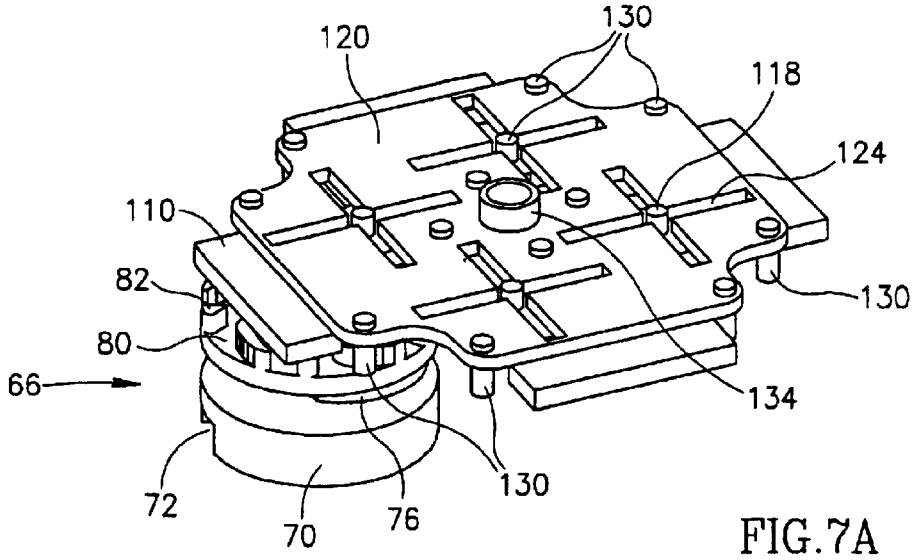
FIGS. 7A and 7B are top isometric views of the manipulating mechanism of the lock, in two consecutive positions.
Figure 7B:
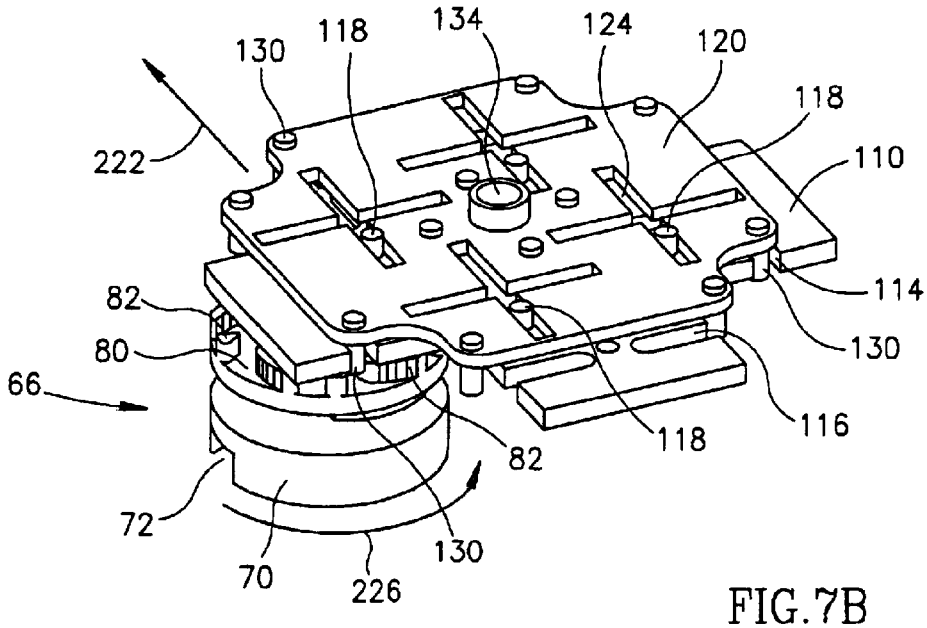

Further attention will now be directed to FIGS. 7 and 8, illustrating the manipulating mechanism of the present invention. In FIGS. 7A and 7B, the manipulating member 120 is illustrated over the guiding track member 110 and with a single locking assembly 66. It is also apparent from these figures that the manipulating member 120 is capable of only X-Y displacement owing to the projection of pins 118 from guiding track member 110 into the corresponding cross-like recesses 124 of the manipulating member 120. In accordance with an embodiment of the invention, the manipulating member 120 is biased into the neutral position of FIG. 7A by one or more suitable springs (not shown).

In FIG. 7A, the manipulating member 120 is in a neutral position and in this particular embodiment neither of the follower pins 130 is engaged with a corresponding cam tooth 82 of cam wheel 80. FIG. 7B illustrates a position wherein the manipulating member 120 has been slidingly displaced in the direction of arrow 222, whereby one of the follower pins 130 engages a facing cam tooth 82 sliding against its cammed surface, entailing corresponding angular displacement (rotation) of the locking assembly 66 in the direction of arrow 226.

FIGS. 8A–8F illustrate a superimposed top view, showing in dashed lines the manipulating member 120 and in solid lines a cam wheel 80. As already mentioned above, the manipulating member 120 comprises four sets of three follower pins 130, each set corresponding with one locking assembly 66. In FIGS. 8A–8F that set of follower pins which corresponds with the illustrated cam wheel 80, are dashed for distinguishing them from other sets of follower pins, not dashed. For the sake of explaining a sequence of manipulations, the concerned follower pins are identified as 130A, 130B and 130C. Further shown, there is one pin 118 (others removed for sake of clarity) projecting from the guiding track member 110 (not shown) slidable within the cross-like recess 124.

Figure 8A:
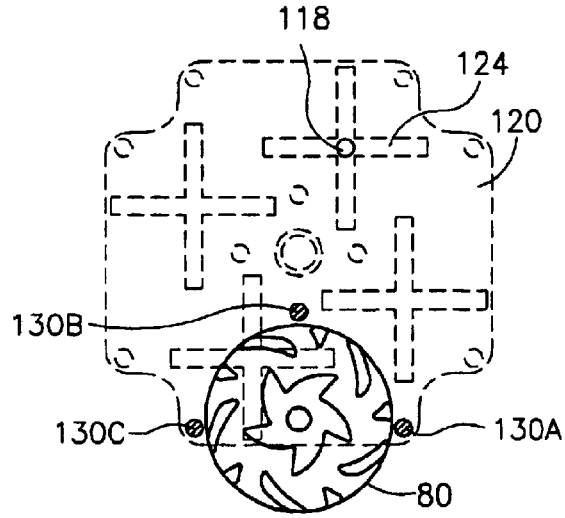
FIGS. 8A to 8F are top views illustrating in superimposed relation, the manipulating member and one of the cam wheels, in a series of consecutive manipulating displacements.

Turning first to FIG. 8A, the manipulating member 120 is illustrated in its neutral position such that pin 118 of the guiding track member 110 is centrally positioned within the cross-like recess 124. In this position, neither of the follower pins 130A, 130B or 130C is engaged with any of the cam teeth of cam wheel 80.

Figure 8B:
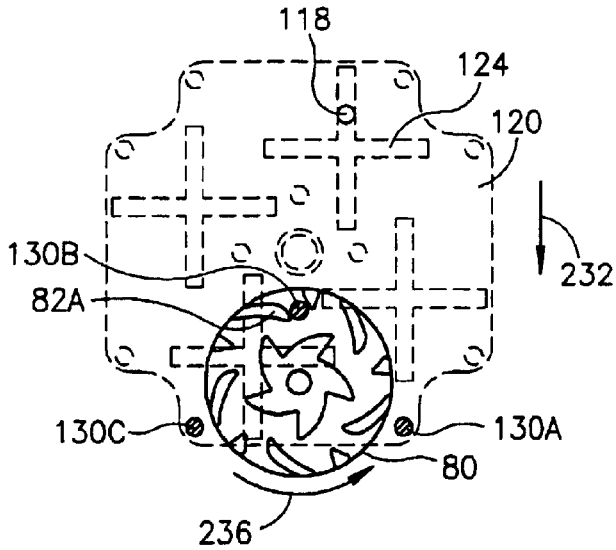
Figure 8C:
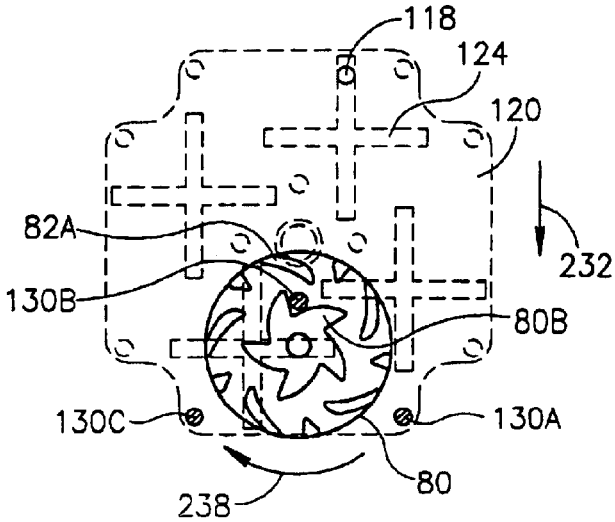

FIG. 8B illustrates the position upon displacing of manipulating member 120 in the direction of arrow 232 whereupon duty following pin 130B encounters cam tooth 82A, entailing rotation of cam wheel 80 in a counter clockwise direction as of arrow 236.

Further displacement of the manipulating member 120 in the same direction, as of arrow 232, entails disengagement of duty follower pin 130B from duty cam 82A towards an engagement with next in duty cam tooth 80B of the inner array of cam teeth, resulting in rotation of the cam wheel 80 in a clockwise direction as represented by arrow 238. Now, the manipulating member 120 is at its end of its downwards stroke since pin 118 has reached the end of the respective portion of cross-like recess 124. It is now necessary to return the manipulating member 120 to its neutral position in the direction of arrow 232, whereupon duty follower pin 130B again encounters duty cam tooth 82A, this time encountering it at its inner surface, entailing rotation of the cam wheel 80 in a clockwise direction as per arrow 238.

Figure 8D:
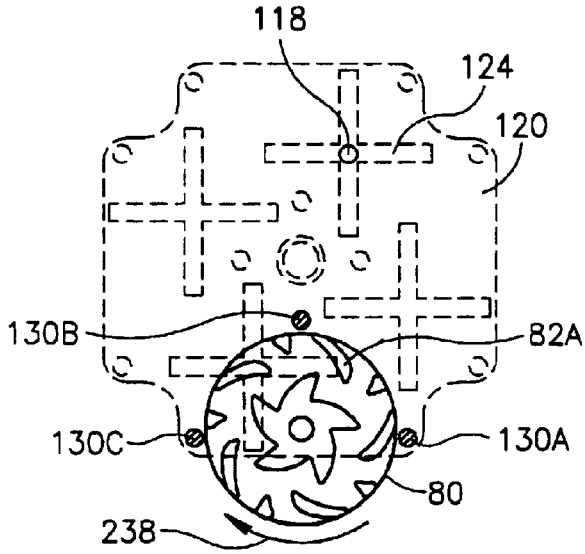
Figure 8E:
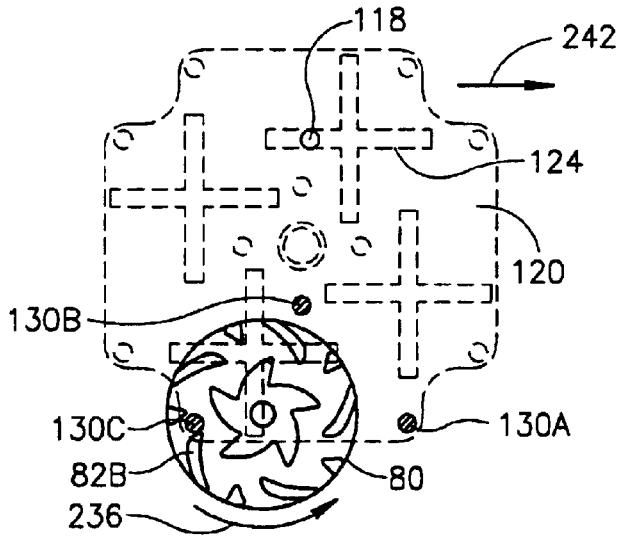
Figure 8F:
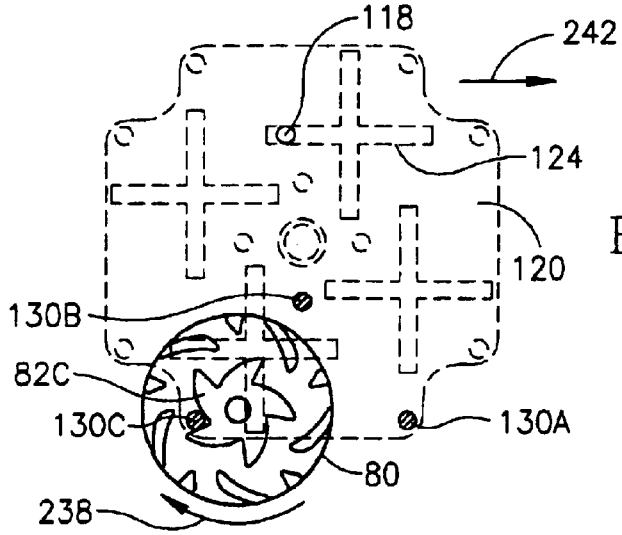

Once the manipulating member 120 has reached its neutral position as in FIG. 8D, it may now be displaced also in a left-right orientation. Upon displacement of the manipulating member 120 rightwards, i.e. in the direction of arrow 242, duty follower pin 130C encounters duty cam tooth 82B, imparting the cam wheel 80 rotation in a counter clockwise direction as per arrow 236. Further displacement of the manipulating member 120 in the same direction as of arrow 242 entails encountering of the duty following pin 130C with another duty cam tooth 82C, entailing rotation of cam wheel 80 in the clockwise direction as illustrated by arrow 238.

Similarly and simultaneously, all the locking assemblies are rotated each time the manipulating member 120 is displaced. However, it may be so designed that in some instances displacement of the manipulating member will not necessarily result in corresponding rotation of one or more of the locking assemblies. Further appreciated, the so-called opening combination of the lock may be pre-designed to any desired pattern and length of sequence of displacements.

Whilst in the above illustrated sequence of manipulations the cam wheel 80 rotated in both clockwise and counter-clockwise directions, it should be appreciated that by a particular embodiment, such angular displacement is possible in a uniform direction, depending however on the particular design of the cam teeth and other geometrical considerations.

Upon completion of the predetermined consecutive displacements of the manipulating member 120, all the locking assemblies 66 are so oriented that the peripheral recesses 72 of the disk members 80 face the corresponding locking lugs 58, whereby the locking lugs 58 spontaneously displace into the recesses 72 under the biasing effect of spring 57, thereby unlocking the lock as discussed hereinabove.

Whilst the disclosure hereinabove refers to biasing the locking member 56 into engagement with the disk members 80, it is appreciated that this is a mere example and said biasing effect may be omitted. Said biasing, however, assists in obtaining the unlocked position such that the locking member will not easily and unintentionally displace, e.g. upon shaking etc.

Figure 9A:
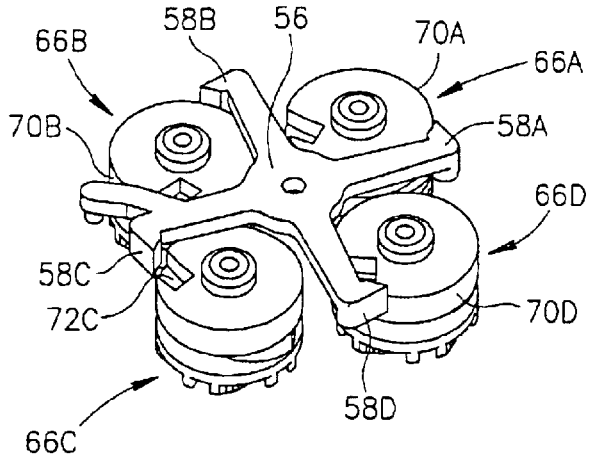
FIGS. 9A to 9C are bottom isometric views illustrating consecutive positions of the locking member and the locking assemblies.
Figure 9B:
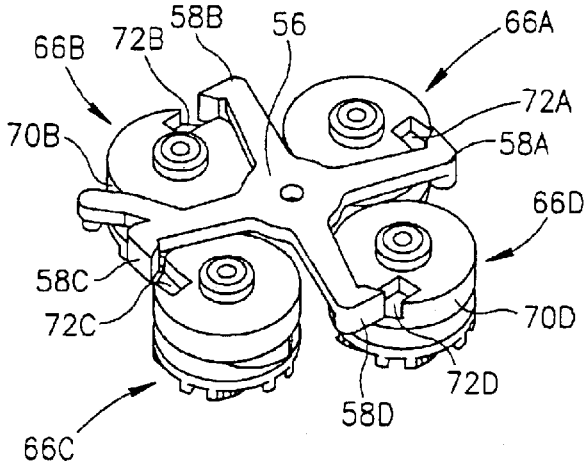
Figure 9C:
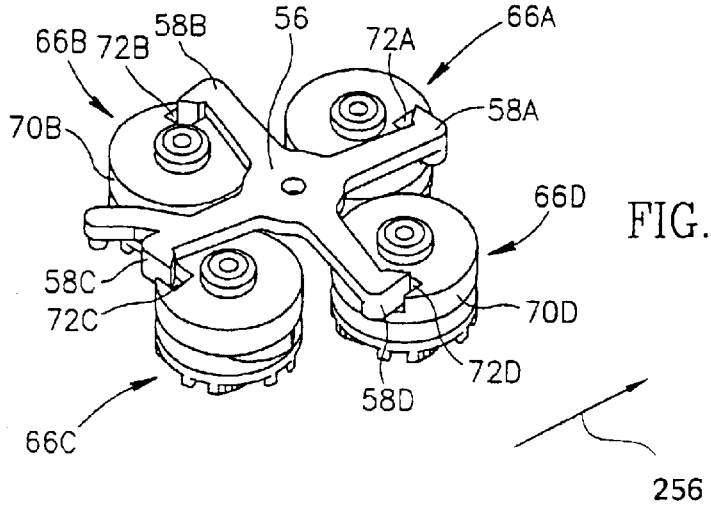

To further understand the invention, reference is now being made to FIGS. 9A–9C illustrating the locking member 52 and the locking assemblies 66, at an isometric bottom view, where for sake of clarification the individual locking assemblies are identified as 66A, 66B, 66C and 66D, with their respective components identified by the same reference letter.

In FIG. 9A, only locking lug 58C extends opposite the corresponding peripheral recess 72C of the locking assembly 66C, whilst locking lugs 58A, 58B and 58D bear against peripheral surfaces of their corresponding disk members 70A, 70B and 70D, respectively, such that the locking member 52 cannot angularly displace into its unlocking position.

In FIG. 9B, the locking assemblies 66 have been further rotated whereby peripheral recesses 72A, 72B and 72D face a corresponding locking lug 58A, 58B and 58D, respectively. However, owing to the fact that peripheral recess 72B is not yet facing its corresponding locking lug 58B, the locking member 52 is barred from rotating into its unlocked position, i.e. into engagement of the locking lugs 58 within the peripheral recesses 72. In FIG. 9C, all the locking assemblies 68A–68D have completed their angular displacement (rotation) into the appropriate position wherein the locking lugs 58A–58D displace into the peripheral recesses 72A–72D, respectively, entailing rotational displacement of the locking member 52 in the direction of arrow 256.

Figure 10A:
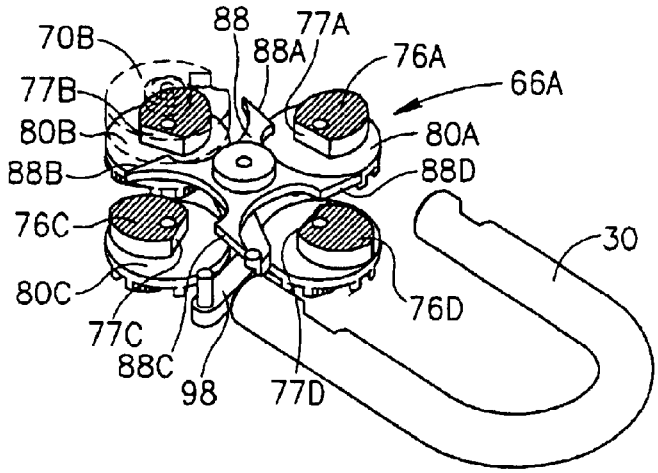
FIGS. 10A to 10C are bottom isometric views illustrating the resetting mechanism, in consecutive positions of a reset operation.
Figure 10B:
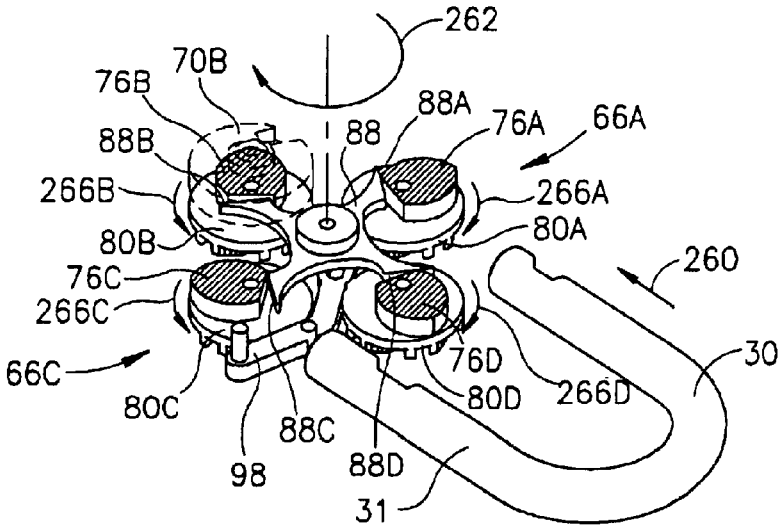
Figure 10C:
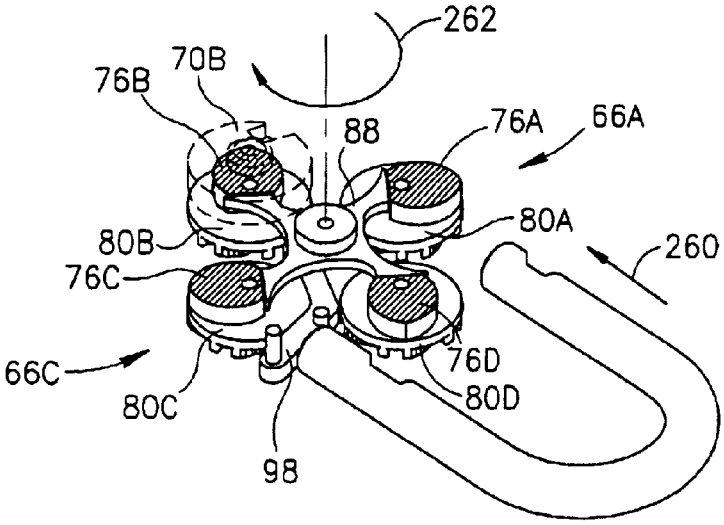

FIGS. 10A–10C refer to the reset mechanism of the lock. A reset mechanism is necessary in order to begin each manipulating session at a so-called "zero position" such that at the end of the predetermined consecutive displacements all the peripheral recesses face the respective locking lugs, allowing the lock to shift into the unlocked position. FIGS. 10A–10C are bottom isometric views in which the locking assemblies are identified as 66A–66D and their respective components are identified by same characterizing letter. For the sake of clarity, the disk members have been cut off and only one disk member 70B, is illustrated in dashed lines for exemplifying its respective position.

The reset member 88 comprises four arms, each formed at its end with a flat cam-engaging surface 88A–88D, each corresponding with a reset cam 76A–76D, respectively. Each of the reset cams 76A–76D has a drop-like shape with an essentially flat base portion 77A–77D, respectively, whereby the so-called 'zero position' or 'reset position' is obtained when all the reset cams are oriented such that their flat surfaces 77A–77D respectively, bear against the corresponding flat surfaces 88A–88D, respectively of the reset member 88, as in the position of FIG. 10C.

FIG. 10A illustrates an arbitrary position of the reset cams 76A–76D. In FIG. 10B shackle 30 is depressed in the direction of arrow 260 whereby its long leg 31 depresses the reset lever 98, entailing corresponding angular displacement of the reset member 88, such that the flat surfaces 88A–88D encounter the cammed surface of the reset cams 76A–76D, applying a tangential moment of force resulting in rotation of the reset cams so as to obtain the position of FIG. 10C, where the flat surfaces 88A–88D rest over corresponding flat surfaces 77A–77D of the respective reset cams 76A–76D.

As noticed in FIG. 10B, the reset operation entails rotation of the reset member in the direction of arrow 262 in FIGS. 10B and 10C, whilst the locking assemblies 66A–66D rotate at an appropriate direction as illustrated by arrows 266A–266D, respectively, in FIG. 10B.

Figure 11:
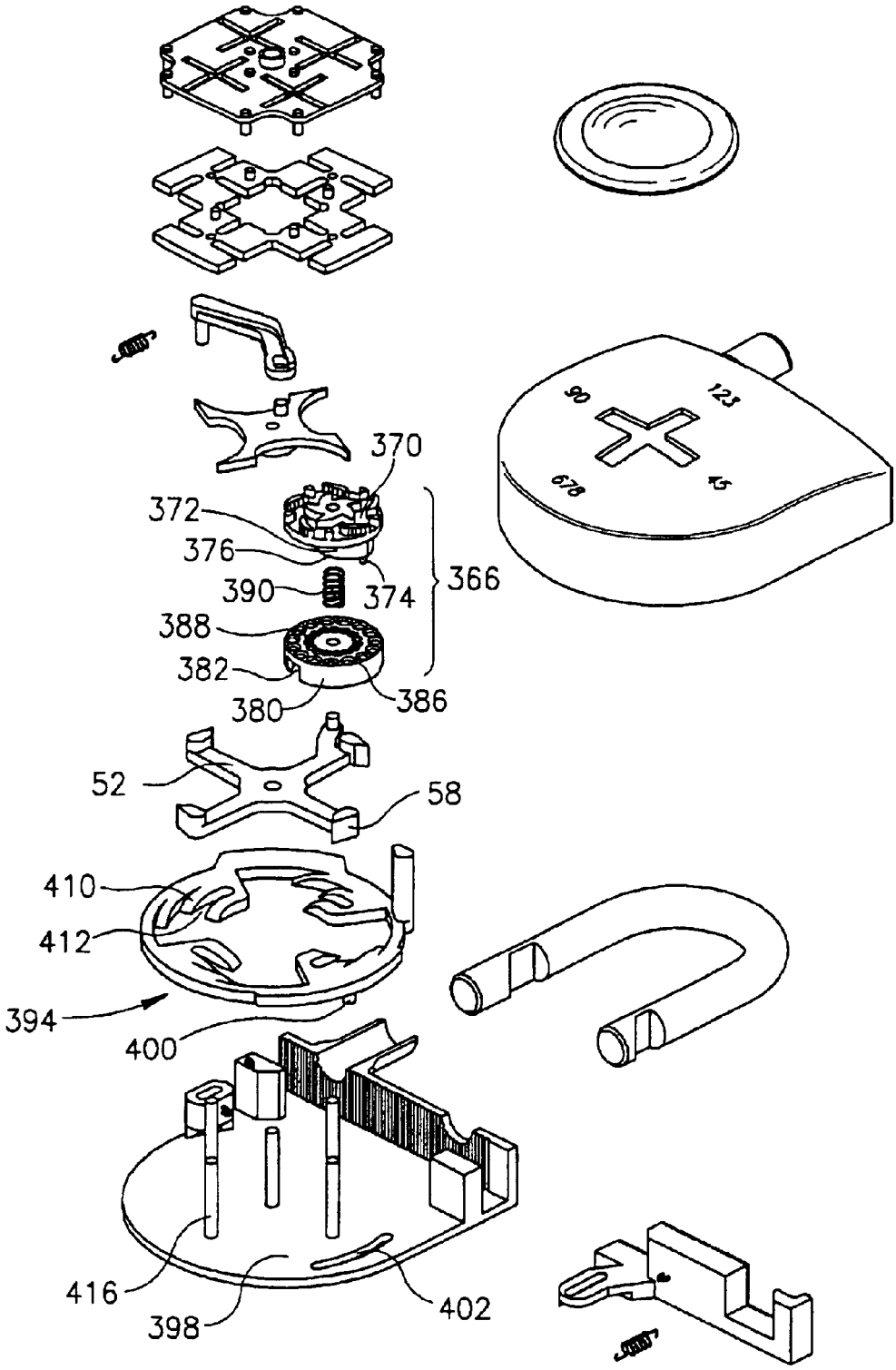
FIG. 11 is an exploded isometric view of a padlock in accordance with a modification of the invention.

The embodiment illustrated in FIGS. 1 to 10 illustrates a lock and a locking mechanism therefore, wherein the unlocking combination is predetermined at manufacturer's level and may not be customized or personalized by the user. The further embodiment illustrated with reference to FIGS. 11 to 13 illustrates an embodiment in which the combination of the lock may be personalized by the user to any desired sequence of displacements as well as any length of sequence of manipulations.

The lock in accordance with this embodiment is in fact similar with the lock of the previous embodiment, the main difference residing in that the locking assembly collectively designated 366 comprises a cam wheel 370 integral with a reset cam 372 formed with several axially projecting pins 374 and 376. However, disk member 380 is separable and is formed with a peripheral recess 382 and at a top surface thereof with a plurality of openings 386 and 388, fitted for receiving projecting pins 374 and 376, respectively, of the reset cam 372. Accordingly, the disk member 380 may be positioned at different angular dispositions with respect to the reset cam 372 and cam wheel 370, though being coaxial with one another. A coiled spring 390 extends between the disk member 380 and the reset cam 372, biasing the two components away from one another.

Figure 12A:
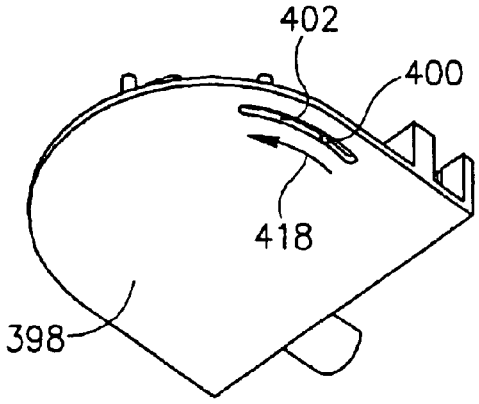
FIGS. 12A to 12C illustrate consecutive steps for personalizing the locking code of a lock according to the embodiment of FIG. 11.

A further difference resides in the addition of a separation member 394, which is rotatably disposed over the bottom wall 398 with a pin 400 axially projecting through an arced recess 402 formed at the bottom wall as can be seen also in FIG. 12A.

It is also noted that the separation member 394 is formed with four ramped surfaces 410 with suitable recesses 412 for receiving the planarly disposed supporting pins 416. Accordingly, it is appreciated that the separating member 394 is rotatable within the housing in a restricted manner, in a clockwise direction only.

Figure 12B:
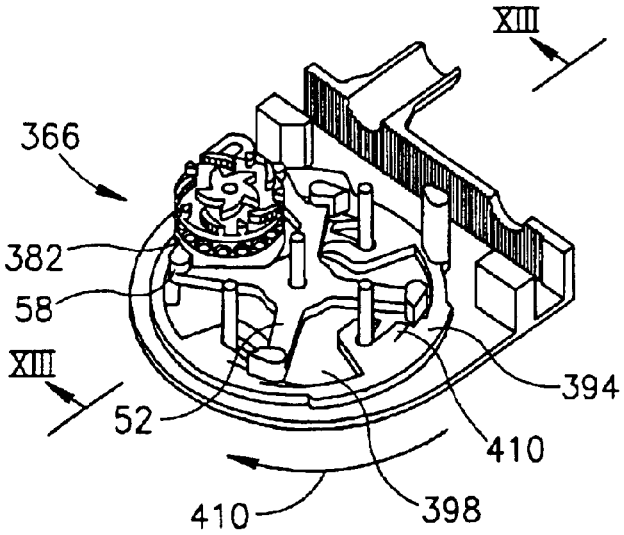
Figure 12C:
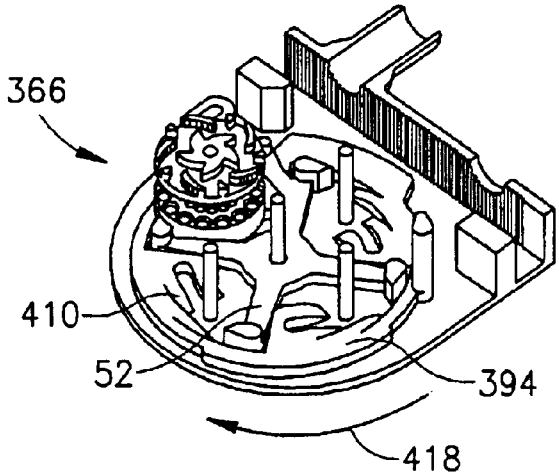

The lock in accordance with the embodiment of FIGS. 12A to 12C operates in a similar manner as disclosed in connection with the previous embodiment. However, when it is required to personalize the combination of the lock, the lock is first manipulated into the unlocked position as discussed above and as illustrated for example in FIGS. 4, 6B and 9C, wherein the locking lugs 58 of the locking member 52 project into the peripheral recesses 382 of disks 380 (FIG. 12B). In this position, (see also FIG. 13A) the peripheral portions of the locking member 52, namely the lugs 58 ride over the separating member 394 retaining the locking member 52 in a somewhat elevated position with respect to the bottom wall 398 and in turn, also maintaining the locking assemblies 366 at a corresponding position, namely, the disk members 380 do not separate from the reset cam 372 under the biasing effect of spring 390.

Figure 13A:
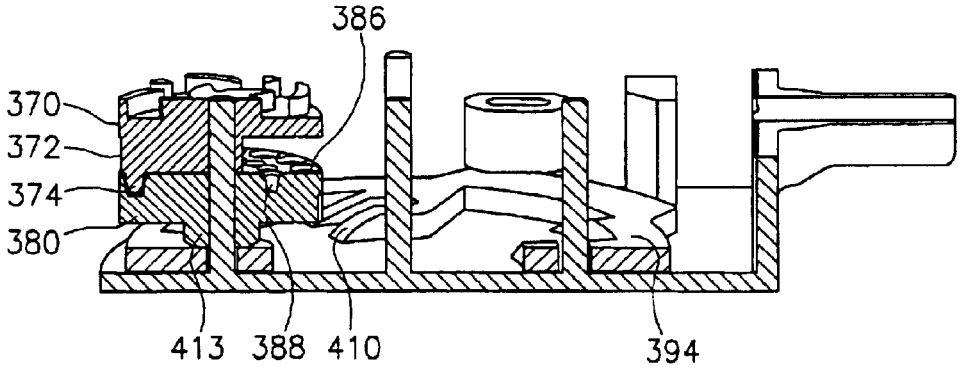
FIGS. 13A to 13C are section views along line XIIV—XIIV in FIGS. 12B and 11C, illustrating consecutive positions of the locking mechanism during personalizing the locking code of the lock.
Figure 13B:
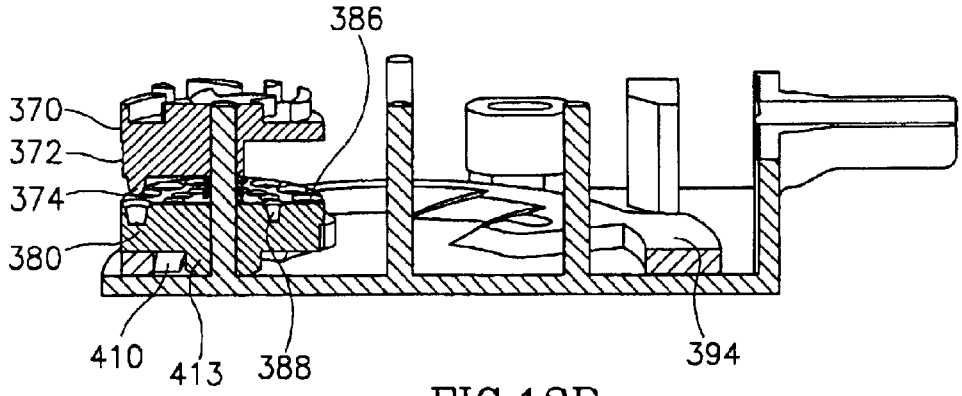

However, when the separating member 394 is rotated in a clockwise direction as illustrated by arrow 418 (FIGS. 12A and 12C), the locking member 52 does not rotate whereby it is axially displaced together with the disk member 380 under the biasing effect of coiled spring 390, resulting in separation of the disk members 380 from the reset cams 372, as illustrated in FIGS. 12C and 13B. At this situation the user may personalize a new-combination of the lock by performing a series of consecutive displacements of the manipulating member. Once the disks members 380 are re-engaged with the reset cams 372 (FIG. 13C) a new combination is set and upon return of the separating member 394 to its original position, the new combination remains.

Figure 13C:
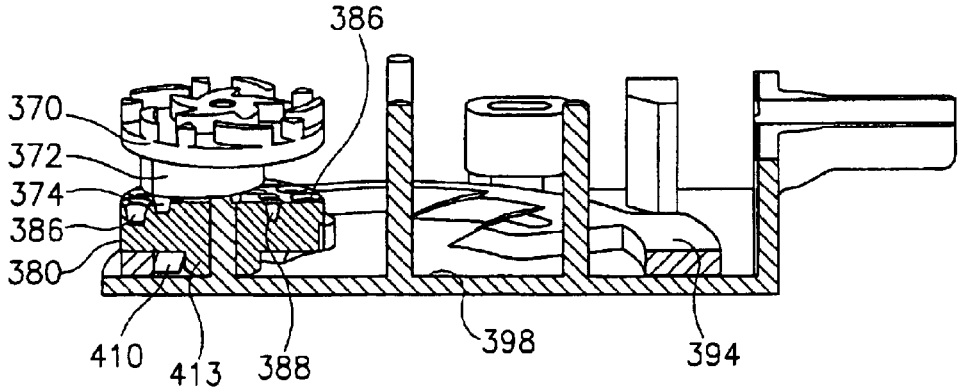

As can best be seen in FIGS. 13A to 13C the disk member 380 comprises a coaxial downward projection 413 the height of which corresponds approximately to the thickness of the separating member 394 as well as the thickness of the locking member 52 to thereby facilitate easy engagement and disengagement during displacement of the locking member 52 and the separating member 394.

Figure 14A:
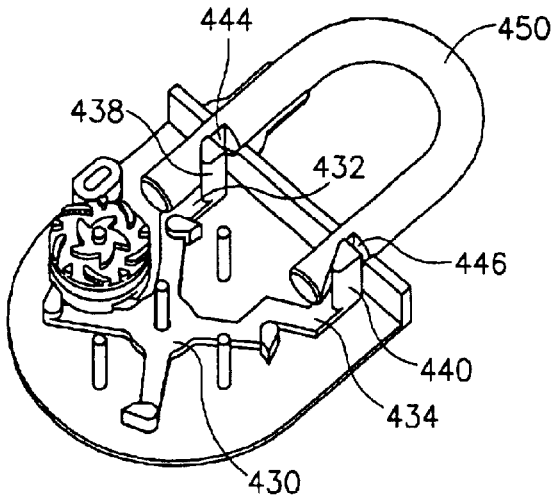
FIGS. 14A to 14C are isometric views of a padlock in accordance with an embodiment of the present invention, in locked, unlocked though closed, and open positions, respectively.
Figure 14B:
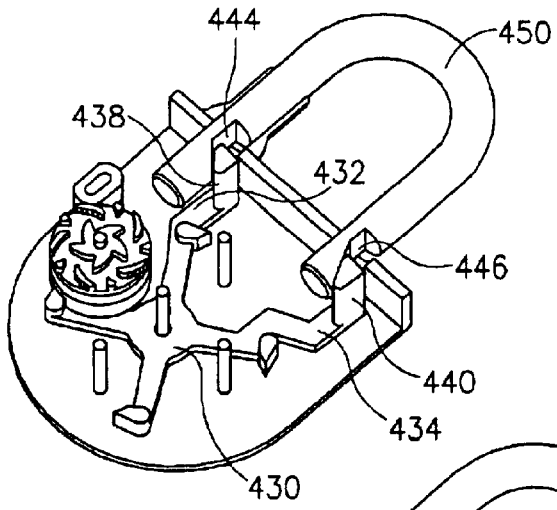
Figure 14C:
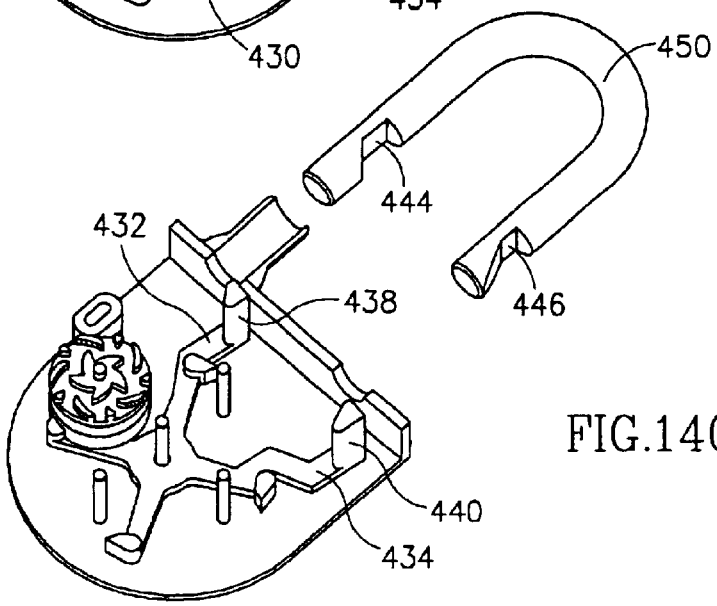

In the embodiment of FIGS. 1 to 13, the locking breach 140 was in the form of a separate member linked to the locking member 52 and manipulated thereby. In FIGS. 14A to 14C, there is illustrated a different embodiment in which the locking breach is integral with the locking member.

In accordance with this embodiment the locking member 430 is integrally formed with two breach arms 432 and 434, each formed at its end with a latch engaging member 438 and 440, respectively fitted for arresting locking latches 444 and 446, respectively of a locking bolt 450, in the form of a U-like shackle.

The arrangement is such that at the locked position (FIG. 14A), the locking member 430 is in its relatively counterclockwise disposed position, since the locking lugs cannot engage within the recesses of the disk member. As a consequence, the latch engaging members 438 and 440 engage with the locking latches 444 and 446, respectively of shackle 450, preventing withdrawal of the shackle.

Upon manipulating the locking mechanism into its unlocked position (FIG. 14B), the locking lugs project into the respective peripheral recesses of the disk members, whereby the locking member displaces in a counterclockwise manner, entailing corresponding displacement of the latch engaging members 438 and 440 rightwards, to disengage from the locking latches 444 and 446, respectively to thus enable extracting the shackle 440 as in FIG. 14C.

It is appreciated that the embodiment referred to in FIGS. 14A–14C comprises principally the same elements as in the previous embodiments and the reader is directed to the description above for understanding how the lock is manipulated between a locked and unlocked position. Furthermore, the lock may be one with a preset combination or one in which the combination may be personalized as discussed in connection with FIGS. 11–13.

In the previous embodiments of FIGS. 1 to 14, the locking assemblies are disposed in a planarly manner, i.e., mounted over axes (support pins) parallel to the central axis (central support pin) of the lock, such that the locking assemblies lie essentially at the same plane. The number of locking assemblies may differ between one and any other practical number, rendering the lock more secure. According to a different application, the locking assemblies are coaxially aligned, i.e. extend on top of one another, as illustrated in the embodiment of FIGS. 15–18. whilst the figures illustrate three locking assemblies, any practical number may be applied.

The lock generally designated 500 comprises a housing consisting of a bottom base 502 and a top casing 504, a cover 503 with a manipulating knob 505 slidingly displaceable thereover. The lock further comprises a locking bolt 506 in the form of a U-like shackle. Shackle 506 has a short leg 508 and a long leg 510, axially and pivotally received within the housing though not removable therefrom. The short leg 508 is formed with a locking latch 514 in the form of a recess and the long leg 510 is formed with a recess 518, a combination pin 520 and a reset pin 524, the purpose of which will become apparent hereinafter. Coaxially mounted on a central axis 528 there are three locking assemblies 530, each comprising a disk member 534 formed with a peripheral recess 536, a reset cam 542 and a cam wheel 546 in the shape of a star. In the normal course of operation the members of a locking assembly 530 bear against each other and are rotatably engaged to one another by means of a coupling element 550 extending through the cam wheel 546 and the reset cam 542, and comprises two axial projections 552 protruding into respective apertures 556 formed in the disk member 534. The array of the three locking assemblies 530 is spring biased in a downward direction by means of a coiled spring member 561.

Figure 16:
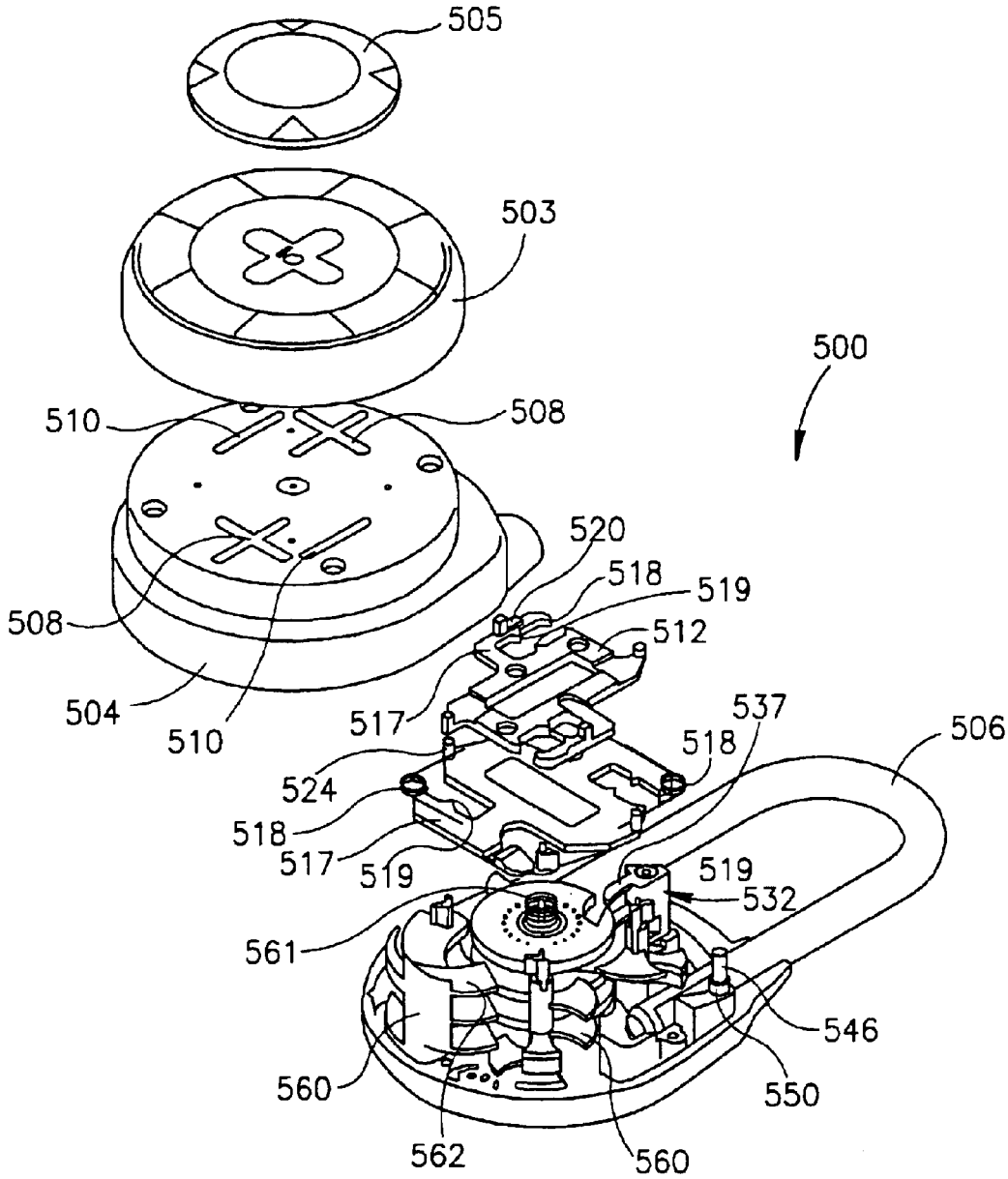
FIG. 16 is an isometric, partially assembled and partially exploded view of the lock of FIG. 15.
Figure 17:
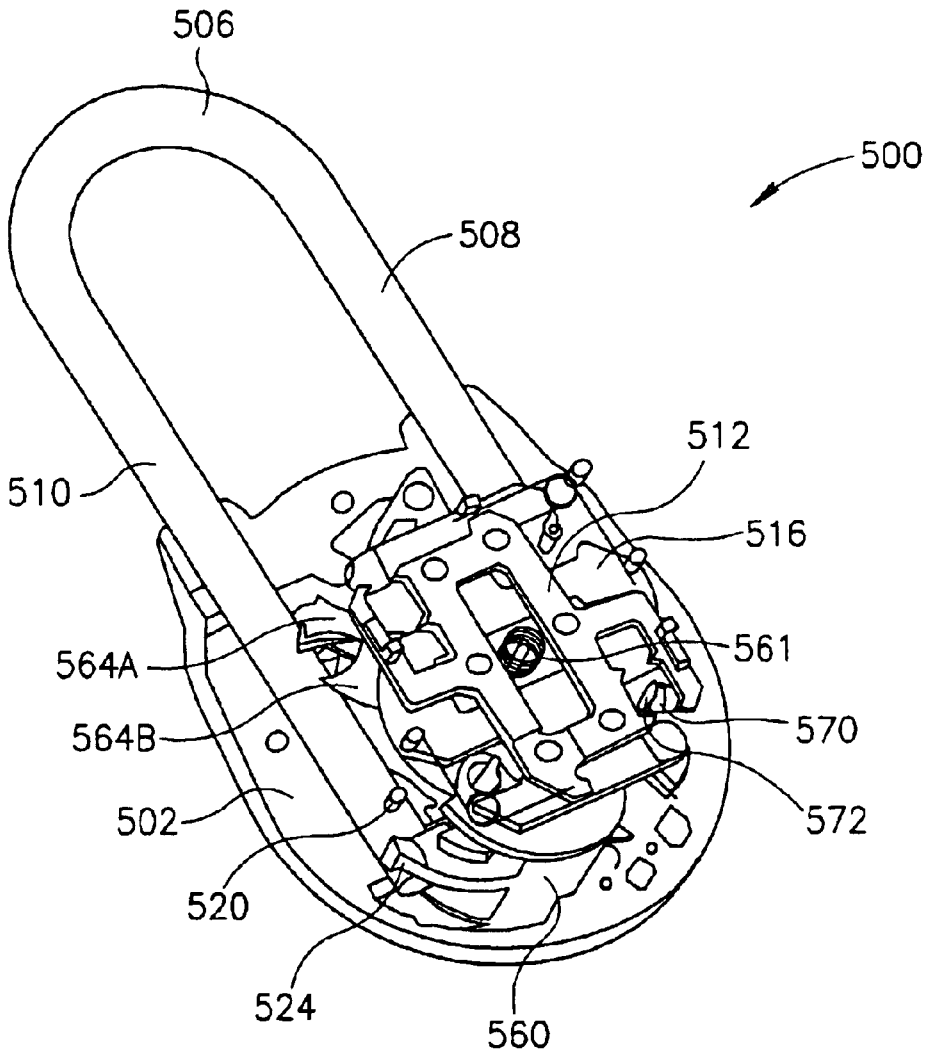
FIG. 17 is an isometric exploded view of the lock of FIG. 16, with the top cover removed.

Noticeable in FIG. 16, the top casing member comprises two cross-like slots 508 parallelly oriented. There are also provided two parallel slots 510, extending parallel to respective portions of the cross-like slots 508.

Planarly displaceable within the housing there are two slides 512 and 516 extending below the top casing 504, wherein the upper slide 512 is formed with two upward axial projections 520 slidingly received within the cross-like recesses 508, and the bottom slide 516 comprises two upward axial projections 524 slidingly received within the linear slots 510. Both the slides 512 and 516 are biased into a neutral position such that the pins 520 and 524 are normally centrally positioned within their respective slots 508 and 510 in the top casing 504.

Each of the slides 512 and 516 is formed with two parallelly extending cogged frame portions 517, each comprising four followers in the form of teeth 518 and 519.

A locking member 532 comprises three fixed locking lugs 537 axially extending and disposed so as to engage with the respective peripheral recesses 536 of the disk members 534. The locking member 532 is mounted on a solid bar 538 formed with a locking breach 542 in the form of an integral blocking member fitted for arresting the locking latch 514 of shackle 506. The locking breach 542 is pivoted to the housing over axle 546 and is biased by coiled spring 550 in a counter-clockwise direction, i.e., such that the locking lugs 537 are biased against the periphery of disk members 534. However, and as explained in connection with is the previous application, projection of the locking lug 537 into the peripheral recesses 536 is enabled only when all the peripheral recesses 536 are axially aligned, i.e. after manipulation thereof.

A reset member 560 comprises three reset levers 562 coaxially extended each facing a reset cam 542 of a respective locking assembly 530. The reset member 560 is normally biased in a clockwise direction, i.e. in a direction so as to disengage from the reset cams 542. However, the reset member 560 may be biased in a counterclockwise direction upon retracting the shackle 506 and depressing it, whereby reset pin 524 (extending at opposite sides of the long leg 510) pivotally displaces the reset member 560, whereby in turn the reset levers 562 apply tangential force on the reset cams 542, biasing them to rotate until the flat surface of each reset cam 542 aligns flush with the respective flat surface of the reset lever 562 as explained in connection with the previous application.

Pivotally secured at peripheral locations around the locking members 530, there are provided four axial manipulating members 560, 562, 564 and 566, each comprising a plurality of arced blades designated as the number of the manipulating member with an index letter A, B or C. The arc of the blades has a contour corresponding with that of the cam wheels 546. Each of the arced blades designated the same index letter is fitted for tangential displacement over a corresponding cam wheel 546, whereby rotation of the manipulating member entails corresponding displacement of the locking assemblies 530. It is appreciated that the cam wheels 546 are engageable by one or more equi-leveled arced blades, whereby the locking assemblies may be manipulated at a high security level.

Each of the manipulating members comprises a double axle arrangement whereby the lower blades 560C, 562C, 564C and 566C are independently rotatable with respect to the upper blades. This is obtained by two flag-like members 570 and 572 extending from each of the axles.

The flag-like members 570 and 572 are received within the cogged frames 517 of the slides 512 and 516, whereby sliding displacement of the slides 512 and 516 in an X-Y like pattern imparts corresponding angular displacements of the manipulating members 560 to 566, owing to engagement of the flag members 570 and 572 with the respective teeth 518 and 519, acting together as a cogged frame mechanism.

The three locking assemblies 530 are mounted on an axially displaceable seat member 580 coaxially received within a ring 584 formed with several peripheral lugs 588 and being engaged with cogged wheel 590 secured to the bottom base 502. The cogged wheel 590 is rotatable by the combination pin 520 of the shackle 506, such that upon depressing the shackle it imparts the cogged wheel 590 with rotary motion which in turn rotates the ring 584. The arrangement is such that rotation of wheel 584 entails axial displacement of seat 580 upwards, owing to corresponding cammed surfaces at both members. Such axial displacement against the biasing effect of spring 561 applies axial force on the cores of the coupling elements 550, whereby they disengage from their respective disk members 534 so it then becomes possible to alter the respective angular positions of the disk members 534 within each locking assembly 530.

Figure 15:
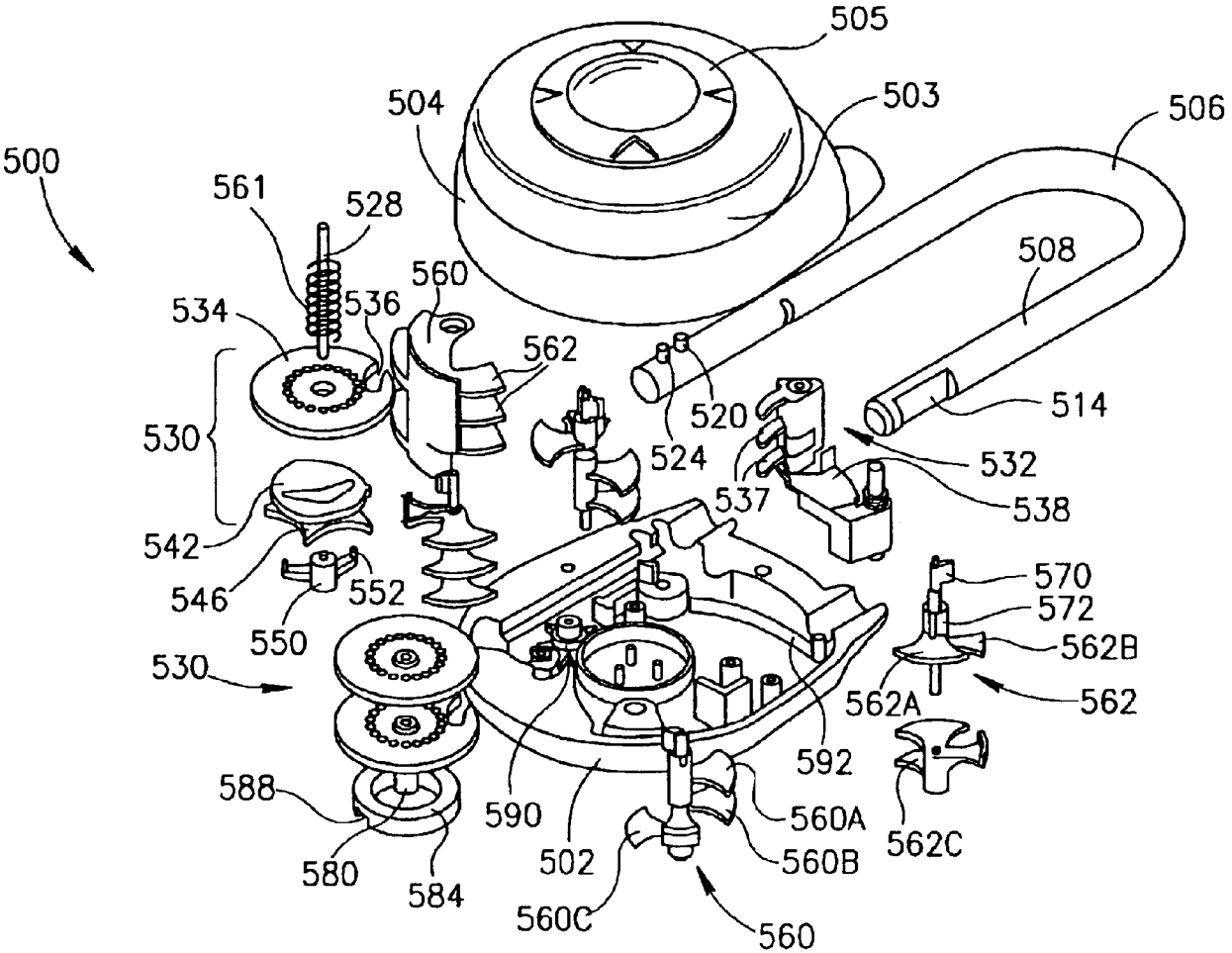
FIG. 15 is an exploded isometric view of a padlock according to a different application of the invention.

Best seen in FIG. 15, there is further received within the housing a toggle spring 592 secured at one end 594 to the housing and at an opposed end to a toggle member 598 formed with a projection 600 engageable with recess 518 of shackle 506. Block member 538 of the locking member 532 is mounted on the toggle spring 592 thereby being positively displaced in either of two positions, namely closed or open. The arrangement is such that projection 600 is engaged within recess 518 of shackle 506, whereby retraction of shackle 506 entails snapping of the toggle spring 590 into a closed position (i.e. concave with respect to the central axis 528) and correspondingly, extraction of the shackle 506 entails snapping of the toggle springs 592 into an open position, respectively (i.e. convex with respect to the central axis 528).

Figure 18:
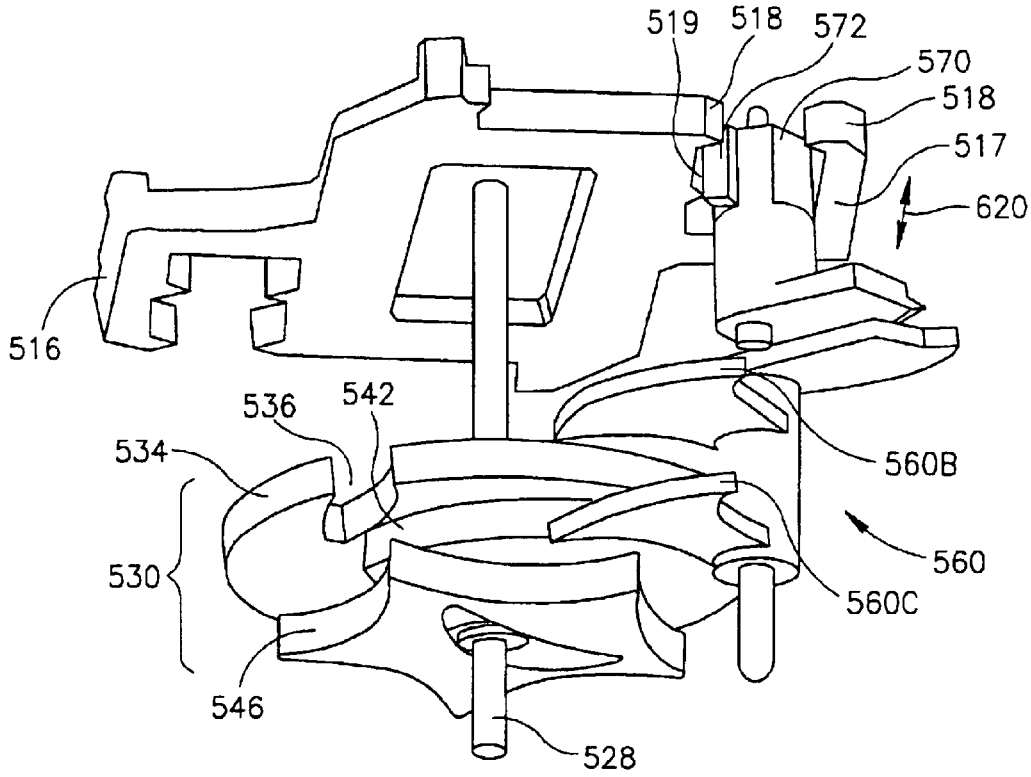
FIG. 18 is an isometric view from below, of a locking assembly of the lock illustrated in FIG. 16.
Figure 19A:
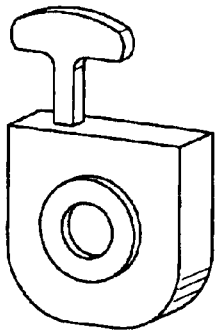
FIG. 19(*a*) is a drawing which depicts a combination lock according to the inventive subject matter, wherein the locking bolt is a one-legged fastener detachable from the lock housing.
Figure 19B:
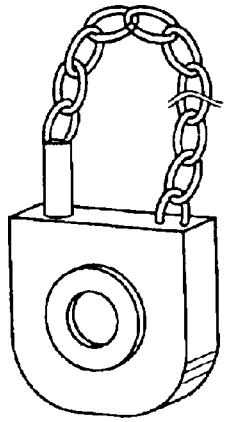
Figure 19C:
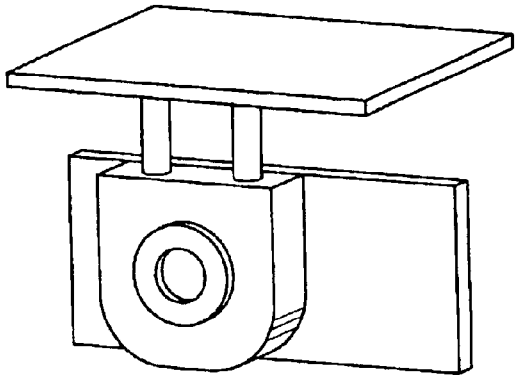
Figure 19D:
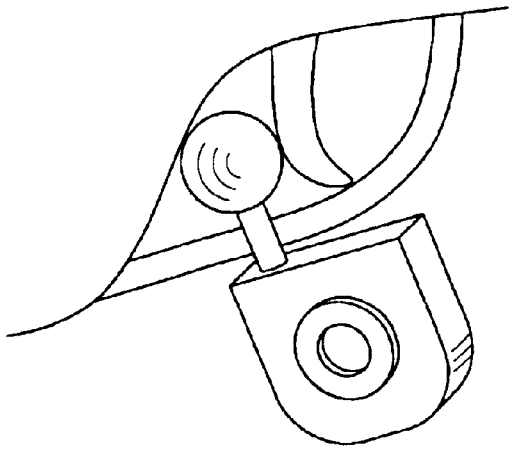

FIG. 18 is a bottom isometric view illustrating only the bottom slide 516, one locking assembly 530 and one manipulating assembly 560, for better understanding their respective cooperation.

Upon displacement of slide 516 linearly in the direction of arrow 620, the flag-like teeth 570 and 572 encounter teeth 518 and 519 of the cogged frame 517, thereby imparting angular displacement to the blades 560B and 560C, the latter being coplanar with cam wheel 546. The angular displacements of the blade 560 entail corresponding angular displacements of cam wheel 546. Cam wheel 546 would be further angularly displaced by corresponding blades 566C, 564C and 562C (not shown in this figure), and blade 560B would engage with corresponding cam wheel 546 of the middle locking assembly (not shown).

Whilst the structure of the lock 500 differs from the structure of the previous application as illustrated in FIGS. 1 to 14, it is appreciated that the principle functions thereof operate in a similar manner. Namely, manipulating the manipulating knob 505 entails displacement of the slides 512 and 516 resulting in consecutive angular displacements of the manipulating members 560 to 566 which in turn impart corresponding angular displacement to their mating cam wheels 546, thus resulting in angular displacement of the disk members 534 into an opening position wherein all peripheral recesses 536 are axially aligned and face the locking lugs 537 of the locking member 532, into the open position in which the shackle 506 may be extracted.

Furthermore, and principally similar to the previous application, depressing shackle 506 results in angular displacement of reset member 560 such that reset levers 560 apply tangential force on the reset cams 542 to rotate them into a zero position wherein the flat surfaces of the reset cams 542 bear against the corresponding surfaces of the reset levers 562 and wherein the reset cams 542 become axially aligned.

Personalizing the combination of the lock is obtained by axially disconnecting the disk members 534 from their associated cam wheel 546 and reset cams 542, changing their angular position with respect thereto and then re-engaging the locking assemblies. This is obtained by depressing shackle 506 whereby the combination pin 520 imparts rotary motion to cogged wheel 590 resulting in rotation of wheel 584 axially displacing seats 580 which in turn axially displaces the couplings 550 to disengage from the disk members 534.

It should be appreciated that the locking mechanisms described hereinabove in accordance with the present invention, is made to meet also the high level security standards, although its easy and essentially fast manipulation. The lock can not be picked at by conventional means (such as applying a stethoscope to a standard dial combination lock to locate its opening positions). Nevertheless, the locking mechanism is suitable for serving in master locks, and even more so. additional locks having the same opening combination may be easily introduced by adjusting their opening combination as explained.

In addition, the lock offers some other serious advantages which are not known with prior art locks, namely, it is possible to manipulate the lock at complete darkness and single handed (both being serious advantages for blind or amputated people) and even while wearing gloves.

It will be appreciated by the artisan that the locks with which the invention is concerned is useful, mutatis mutandis, for a variety of other applications, e.g. doors, windows, vehicle doors, lockers, etc.

What is claimed is:

1. A combination lock comprising:

a housing, a locking bolt with at least one leg portion extending into the housing and formed with a locking latch, and a locking breach for arresting said locking latch;

at least one locking assembly rotatably supported within the housing; each locking assembly comprising a disc member formed with a peripheral recess, a cam wheel formed with cam teeth, and a reset cam;

a locking member formed with at least one locking lug, each corresponding with a disc member; said locking member being angularly displaceable between an un-locked position in which all the at least one looking lugs are engaged within the peripheral recess of the corresponding disc member and wherein the locking breach is disengaged from the locking bolt; and a locked position in which at least one of the locking lugs is disengaged from the corresponding peripheral recess, wherein the locking breach arrests the locking bolt;

a reset mechanism comprising a reset member for applying force on the reset cam of each of the at least one locking assembly, to thereby rotate the associated disc member into a reset position;

a single manipulating member comprising at least one follower corresponding with each cam wheel and being planarly displaceable within the housing;

the arrangement being such that upon predetermined consecutive displacements of the manipulating member corresponding with a combination code of the lock, the at least one follower encounters the cam teeth of a respective cam wheel, entailing corresponding consecutive angular displacement of each of the at least one locking assembly into a position in which each of the peripheral recesses faces a corresponding locking lug, thus allowing the locking member to shift into the un-locked position.

2. A combination lock according to claim 1, comprising at least two locking assemblies coaxially disposed within the housing, wherein the locking member is in the form of a lever comprising a corresponding number of locking lugs and pivotally displaceable between the locked and the un-locked positions.

3. A combination lock according to claim 2, wherein the un-locked position the peripheral recesses are axially aligned.

4. A combination lock according to claim 2, wherein locking lugs of the locking member are axially aligned.

5. A combination lock according to claim 1, wherein the cam wheel and the reset cam are integral with the disc member, whereby the combination code of the lock is pre-programmed.

6. A combination lock according to claim 1, wherein at least the cam wheel is axially detachable from the disc member, whereby it can be angularly shifted to preset one of a plurality of angular positions, whereby the combination code of the lock may be changed to any personalized combination.

7. A combination lock according to claim 6, wherein the personalized combination may comprise an un-limited number of consecutive displacements of the manipulating member.

8. A combination lock according to claim 6, wherein the cam wheel is normally axially biased away from the disc member.

9. A combination lock according to claim 6, wherein the cam wheel and the reset cam are integral with one another.

10. A combination lock according to claim 6, wherein the locking member is axially displaceable between an operative position in which it extends under a limiting portion of the disc member and prevents axial displacement of the disc member to disengage from the cam wheel, and a combination resetting position in which it disengages from the limiting portion to allow axial displacement of the disc member.

11. A combination lock according to claim 10, wherein there is further provided a separating member displaceable between a first position in which it bears against the locking member to prevent it from displacing from its corresponding operative position, and a second position in which it displaces so as to allow the locking member to displace into the combination resetting position.

12. A combination lock according to claim 11, wherein the separating member is slidingly rotatable within the housing between the first position in which it bears under the locking member, and the second position in which it disengages from the locking member.

13. A combination lock according to claim 12, wherein one or both of the separating member and the locking member are formed with a gliding surface to facilitate displacement of the locking member over the separating member.

14. A combination lock according to claim 1, wherein the cam wheel comprises a central star-like member formed with a plurality of spikes, each spike having a cam surface slidingly engageable by a follower of the manipulating member.

15. A combination lock according to claim 14, wherein the cam wheel further comprises a circular array of cam elements disposed adjacent the periphery of the cam wheel, each cam element comprising a cam surface slidingly engageable by a follower of the manipulating member.

16. A combination lock according to claim 1, wherein the manipulating member is displaceable within the housing in a cross-like pattern.

17. A combination lock according to claim 16, wherein the manipulating member is manipulated by a manipulating finger-engageable knob.

18. A combination lock according to claim 17, wherein the finger-engageable knob projects from a front wall of the housing.

19. A combination lock according to claim 17, wherein the manipulating member is ergonomically oriented.

20. A combination lock according to claim 16, wherein the manipulating member is biased into a neutral position in which the at least one follower is disengaged from the cam wheel.

21. A combination lock according to claim 1, comprising at least two locking assemblies, planarly disposed within the housing about a central axis thereof.

22. A combination lock according to claim 21, wherein the locking member is angularly displaceable about the central axis.

23. A combination lock according to claim 22, wherein the locking member is a cross-like member comprising a plurality of radial arms, each fitted at a distal end thereof with a locking lug.

24. A combination lock according to claim 1, wherein the locking breach is integral with the locking member.

25. A combination lock according to claim 1, wherein the locking breach is pivotally articulated to the locking member wherein displacing the locking member into its un-locked position entails corresponding displacement of the locking breach into disengagement from the locking latch of the locking bolt, and wherein displacing the locking member into its locked position entails corresponding displacement of the locking breach into engagement with said locking latch.

26. A combination lock according to claim 25, wherein the locking breach is a bar formed with at least one latch engaging portion; wherein at the locked position the latch engaging portion engages with the locking latch to thereby arrests the locking bolt, and further wherein axial pulling force applied to the locking bolt entails displacement of the locking breach into engagement with the housing, whereby said axial pulling force wedges the locking breach within the housing at the locked position such that the axial force is not transferred to the locking member and the at least one locking assembly.

27. A combination lock according to claim 26, wherein the locking breach and the housing are each formed with a serrated portion, whereby engagement of the serrated portions entails wedging the locking breach at the locked position.

28. A combination lock according to claim 26, wherein the locking latch is a recess formed in the locking bolt, engageable by the locking breach.

29. A combination lock according to claim 28, wherein the recess of the locking bolt is formed with a gliding surface intersecting a longitudinal axis of the locking bolt; and the least one latch engaging portion of the locking breach is formed with a corresponding inclined surface, wherein axial displacement of the locking bolt entails combined axial and lateral displacement of the locking breach into wedging the locking breach within the housing.

30. A combination lock according to claim 26, wherein the locking breach is biased away from wedging within the housing.

31. A combination lock according to claim 1, wherein a lever arm of the reset member applies a tangent force component on the reset cam of each of the at least one locking assembly, to thereby rotate the associated disc member into a reset position.

32. A combination lock according to claim 1, wherein the at least one locking assembly automatically scrambles when the locking bolt is closed.

33. A combination lock according to claim 1, wherein the lock is a padlock and the locking bolt is a U-like shackle.

34. A combination lock according to claim 33, wherein both legs of the shackle are formed with a locking latch engageable by the locking breach.

35. A combination lock according to claim 1, wherein the locking bolt is a one-legged fastener detachable from the lock housing.

36. A combination lock according to claim 35, being a chain lock wherein the locking bolt is linked to the chain.

37. A combination lock according to claim 1, being a built-in lock wherein the housing is bolted to a door or frame member.

38. A combination lock according to claim 1, being a firearm safety lock and wherein the locking bolt is fitted for locking engagement with a trigger guard of the firearm.

39. A combination lock according to claim 31, wherein the reset member comprises reset arms, each corresponding with a reset cam, wherein each reset arm comprises a flat portion corresponding with a flat portion of the reset cam.

40. A combination lock according to claim 31, wherein the reset member is linked to a reset lever activated by the shackle.

* * * * *

UNITED STATES PATENT AND TRADEMARK OFFICE

CERTIFICATE OF CORRECTION

PATENT NO. : 6,718,803 B2
APPLICATION NO. : 10/138532
DATED : April 13, 2004
INVENTOR(S) : Knoll It is certified that error appears in the above-identified patent and that said Letters Patent is hereby corrected as shown below:

Claim 29, Column 18, Lines 20-21,
Please delete "the least"
and
replace with
-- the at least --

Signed and Sealed this

Sixth Day of May, 2008

JON W. DUDAS
*Director of the United States Patent and Trademark Office*